US010617907B2

(12) United States Patent
Johnson

(10) Patent No.: US 10,617,907 B2
(45) Date of Patent: Apr. 14, 2020

(54) MOBILE UPPER EXTREMITY (UE) SUPPORTS FOR USE IN RAILED ENVIRONMENTS: CROSSOVER ARM DESIGN ASSEMBLY AND UNILATERAL UE SUPPORT DESIGNS

(71) Applicant: Cynthia Louise Johnson, Coupeville, WA (US)

(72) Inventor: Cynthia Louise Johnson, Coupeville, WA (US)

(73) Assignee: NEUROMOBILITY LLC, Coupeville, WA (US)

( * ) Notice: Subject to any disclaimer, the term of this patent is extended or adjusted under 35 U.S.C. 154(b) by 0 days.

(21) Appl. No.: 15/835,062

(22) Filed: Dec. 7, 2017

(65) Prior Publication Data

US 2018/0093125 A1 Apr. 5, 2018

Related U.S. Application Data

(63) Continuation-in-part of application No. 15/790,827, filed on Oct. 23, 2017, which is a continuation of
(Continued)

(51) Int. Cl.

| | |
|---|---|
| ***E04G 3/00*** | (2006.01) |
| ***A63B 21/00*** | (2006.01) |
| ***A61H 3/04*** | (2006.01) |
| ***A63B 3/00*** | (2006.01) |
| ***A63B 23/04*** | (2006.01) |

(Continued)

(52) U.S. Cl.

CPC ..... *A63B 21/15* (2013.01); *A61H 3/04* (2013.01); *A63B 3/00* (2013.01); *A63B 21/40* (2015.10); *A63B 21/4027* (2015.10); *A63B 21/4035* (2015.10); *A63B 21/4045* (2015.10); *A63B 22/20* (2013.01); *A63B 23/0464* (2013.01); *A61H 2201/1638* (2013.01); *A63B 22/0235* (2013.01); *A63B 69/0057* (2013.01); *A63B 69/0064* (2013.01); *A63B 71/0009* (2013.01); *A63B 2022/0094* (2013.01)

(58) Field of Classification Search

CPC ..... A61H 3/04; A63B 69/18; A63B 21/00
See application file for complete search history.

(56) References Cited

U.S. PATENT DOCUMENTS 2,362,466 A * 11/1944 Carter ..... A61H 3/04 135/67
3,098,651 A 7/1963 Murcott
(Continued)

FOREIGN PATENT DOCUMENTS

DE 10 2007 015 106 A1 10/2008
DE 10 2015 117 484 B3 1/2017
(Continued)

*Primary Examiner* — Amy J. Sterling
(74) *Attorney, Agent, or Firm* — Fay Sharpe LLP

(57) ABSTRACT

A patient aid assembly includes an upper extremity support assembly and a housing associated therewith. The housing slidingly engages a rail and allows relative movements therealong. First and second upper extremity support assemblies are received on first and second rails, respectively. An interconnecting member us hingedly connected to each of first and second housings that support the UE support assemblies.

30 Claims, 36 Drawing Sheets

Related U.S. Application Data application No. 14/719,311, filed on May 21, 2015, now Pat. No. 9,795,825, application No. 15/835,062, filed on Dec. 7, 2017, which is a continuation-in-part of application No. PCT/US2016/060411, filed on Nov. 3, 2016.

(60) Provisional application No. 62/431,131, filed on Dec. 7, 2016, provisional application No. 62/001,353, filed on May 21, 2014, provisional application No. 62/043,807, filed on Aug. 29, 2014, provisional application No. 62/091,191, filed on Dec. 12, 2014, provisional application No. 62/250,291, filed on Nov. 3, 2015.

(51) Int. Cl.

| | |
|---|---|
| ***A63B 22/20*** | (2006.01) |
| *A63B 22/02* | (2006.01) |
| *A63B 69/00* | (2006.01) |
| *A63B 71/00* | (2006.01) |
| *A63B 22/00* | (2006.01) |

(56) References Cited

U.S. PATENT DOCUMENTS

| | | | | |
|---|---|---|---|---|
| 3,442,276 | A | | 5/1969 | Edwards et al. |
| 4,248,256 | A | | 2/1981 | Thomas |
| 4,529,194 | A | * | 7/1985 | Haaheim ..... A63B 21/012 482/70 |
| 4,587,961 | A | | 5/1986 | Ventura et al. |
| 4,748,994 | A | * | 6/1988 | Schultz ..... A61H 3/04 135/67 |
| 5,407,406 | A | | 4/1995 | Canela |
| 5,499,955 | A | * | 3/1996 | Becker ..... A61H 3/00 434/255 |
| 5,588,456 | A | | 12/1996 | Hart |
| 5,941,800 | A | * | 8/1999 | Laconis ..... A63B 69/18 482/51 |
| 6,279,591 | B1 | | 8/2001 | Obitts |
| 7,422,550 | B1 | | 9/2008 | Pinero et al. |
| 7,998,043 | B2 | | 8/2011 | Zhou et al. |
| 8,137,250 | B1 | | 3/2012 | Caban |
| 8,251,079 | B1 | | 8/2012 | Lutz et al. |
| 8,573,612 | B1 | | 11/2013 | Fulk et al. |
| 9,022,397 | B1 | | 5/2015 | Prettyman |
| 9,795,825 | B2 | | 10/2017 | Johnson |
| 2008/0079230 | A1 | | 4/2008 | Graham |
| 2010/0193264 | A1 | | 8/2010 | Kurek |
| 2013/0180557 | A1 | | 7/2013 | Triolo et al. |
| 2014/0209133 | A1 | | 7/2014 | Pak et al. |

FOREIGN PATENT DOCUMENTS

| | | |
|---|---|---|
| EP | 0 624 357 A1 | 11/1994 |
| JP | 2007-280709 A | 10/2007 |
| JP | 2009-106446 A | 5/2009 |
| WO | WO 2017/032376 A1 | 3/2017 |
| WO | WO 2017/079491 A1 | 5/2017 |

* cited by examiner

MOBILE UPPER EXTREMITY (UE) SUPPORTS FOR USE IN RAILED ENVIRONMENTS: CROSSOVER ARM DESIGN ASSEMBLY AND UNILATERAL UE SUPPORT DESIGNS

This application claims the priority benefit of U.S. provisional application Ser. No. 62/431,131, filed Dec. 7, 2016, the entire disclosure of which is expressly incorporated herein by reference. This application also claims priority from and is a continuation-in-part of pending U.S. non-provisional application Ser. No. 15/790,827, filed Oct. 23, 2017, the entire disclosure of which is expressly incorporated herein by reference, which is a continuation of U.S. Ser. No. 14/719,311, filed May 21, 2015, the entire disclosure of which is expressly incorporated herein by reference, which is now U.S. Pat. No. 9,795,825, which claims the priority benefit of U.S. provisional application Ser. No. 62/001,353, filed May 21, 2014, the entire disclosure of which is expressly incorporated herein by reference, Ser. No. 62/043,807, filed Aug. 29, 2014, the entire disclosure of which is expressly incorporated herein by reference, and Ser. No. 62/091,191, filed Dec. 12, 2014, the entire disclosure of which is expressly incorporated herein by reference. This application also claims priority from and is a continuation-in-part of international application Serial No. PCT/US2016/060411, filed Nov. 3, 2016, the entire disclosure of which is expressly incorporated herein by reference, and which claims the priority benefit of U.S. provisional application Ser. No. 62/250,291, filed Nov. 3, 2015, the entire disclosure of which is expressly incorporated herein by reference.

FIELD OF THE INVENTION

This disclosure is directed to assistive device technologies which are accessories for railed devices used for rehabilitation and exercise, such as single rail devices, parallel bars, hemiplegic bars, treadmills, walkers, and the like. In particular, accessories which are related to upper extremity (UE) support and movement, and which can be used for gait rehabilitation, ambulation activities, balance and coordination training, conditioning and strengthening and other therapeutic activities as well as for upper body rehabilitation and exercise.

BACKGROUND

Railed devices have one or two rails. The user necessarily grips the rail(s) with one or both hands for balance or to enable upper body weight bearing when support is needed. Adequate upper body function is therefore needed to use these devices and this is often lacking in the populations who use these devices. Various means to support a user's upper extremity and provide adequate rail contact are needed (such as forearm support and an accommodating grip handle for facilitating grip contact with the support surface) to enable stable support of a statically positioned UE or stable upper body support while a body moves relative to the rail(s) and thus to enable use of these railed devices by many more numbers and types of users. Also needed on all railed devices is enablement and facilitation of UE movement, such as needed for repetitive, reciprocating UE movement akin to arm swinging as well as for alternating UE placement. Movement of the UE and upper body is a component of normal gait kinematics and is desirable for multiple physiologic and mechanical reasons and is not currently enabled when support is needed on a treadmill. When walking along one or two rails, the user necessarily grips and releases the rail(s) in order to advance. This represents discontinuous support as opposed to continuous support such as is offered by, and performed with, wheeled overground mobility aids such as walkers and rollators and gait trainers. Users who are quite weak or otherwise unbalanced may find it difficult to release the rail. It would be desirable to have continuous upper body support when walking along a rail(s) of a railed device. This would safeguard and improve gait kinematics. It would be desirable to have continuous mobile support enabling the UEs to move simultaneously, as is performed during three point gait, as well as continuous support enabling the UEs to move independently of each other, such as in alternating fashion such as during four and two point gait patterns. Clinical needs exist for unilateral as well as bilateral, mobile and static UE support on railed devices. Parallel rails offer a good substrate for training in proper incorporation of the upper extremities in gait, particularly with the assistive devices presented herein. Devices with two rails are the most frequently used type of rail system used by individuals with one-sided UE involvement in rehabilitation. Gait training using these devices and subsequently training with overground mobility aids such as walkers, hemiwalkers, and canes, is lacking in terms of mechanical means to address support and movement of an involved upper limb(s). Asymmetrical upper and lower body movement and weight bearing result. It would be desirable to have a device which offered mobile unilateral UE support on the rail for addressing rehabilitation of the weaker UE while the stronger limb grabs the rail for support. A device is also needed which provides bilateral mobile UE support, to facilitate training in symmetrical gait patterns which could be continued with novel overground mobility aids which offer support and enable reciprocation UE movement. Mobile UE assemblies are needed to improve gait kinematics, including movement and function of the upper extremities and the upper body in railed devices. On mobility aids such as walkers and rollators, forearm platform support assemblies are incorporated to accommodate decreased ability to manage the device by gripping, for postural support, for provision of additional support such as is needed by the bariatric population and other users with significant generalized or lower body weakness, for training in minimization of upper body weight bearing, among other reasons. Forearm support assemblies are also needed for these same reasons on railed devices. A gripping surface can be attached to a standard grip of a walker, for example, which conforms to a hand, to improve contact and control in the presence of gripping dysfunction. It would be desirable to have a support surface for use on railed devices, which accommodates a hand, in order to facilitate gripping contact. This may be needed unilaterally, bilaterally, or in combination with a forearm support assembly. A mobile grip handle support would also be useful to facilitate work on arm movement during walking, in users with normal UE function. One can also envision support assemblies which would accommodate other portions of an upper limb in addition to forearm and grip presented above, such as axillary support. Orthoses to accept the distal end of various levels of amputated limbs could also be secured to a mobile assembly.

Crossover Arm Design

The crossover arm design is functional on railed devices comprised of two parallel rails. The crossover arm design Assembly includes a hinged interconnecting member (crossover arm assembly) which interconnects two (2) housings, each resting upon one rail of the device which has two parallel rails. An UE support surface (forearm support assembly or grip handle assembly, or other) is attached to a housing to create a mobile UE support assembly. A support surface may be attached to one or both housings, depending on the desired functionality as will be described. The mobile housing and support surfaces are the same components used for the unilateral system #1, described below. The crossover arms provide for rotational stabilization of the housings about the rails. Additional functional attributes of this feature will be explained below and include the following: enablement and facilitation of bidirectional walking when unilateral support is needed; static symmetrical/parallel positioning of housings; provision of a mechanical delimitation of excursion distance between UEs; enablement of bidirectional walking when bilateral support is needed; visual and mechanical enhancement of alternating placement of UE assemblies, and others.

This entire assembly can be used for either unilateral or bilateral UE support for use when a user faces a direction which is parallel to the rails, as well as for unilateral support when the user faces perpendicular to a rail such as for side stepping activities. Unilateral support is enabled by moving one of the housings fore or aft along the rail, such that the user can grip the rail with one first hand or allow the first UE to be unsupported while the second UE is supported. For side stepping, when the user faces perpendicular to a rail, the support surface is rotated 90 degrees for support of one UE. The housing which rests on the opposite rail is positioned to accommodate the user's body, and the central hinge is locked in place. In this way, the entire assembly moves as a one piece unit when the user steps. The two (2) crossover arms are hinged together by the central hinge. A lock bar spans the angle formed by the central hinge and can be locked or unlocked depending on desired functionality as outlined below. A hinge secures the opposite end of each of the crossover arms to each of the two respective housings.

A locking mechanism could be introduced to these hinges.

The assembly can be used bidirectionally, i.e. hinged linkage in front of or behind the user, irregardless if used for unilateral or bilateral UE support. When used for bilateral UE support, the hinged linkage can be statically positioned by a locking mechanism or lock bar such that the supports remain statically positioned (symmetrically or asymmetrically) relative to each other, or the central hinge on this linkage can be unlocked which allows the two assemblies to be asymmetrically positioned and moved independently upon the rail.

An UE support assembly can be used for static support on the rail by tightening the brake knob. Static support is also achieved by engaging the hand brake lever during use. Various functionalities provided for, by securing central linkage only, securing all three hinges, or enabling free movement at all three hinges.

An assembly is provided whose (housing) can glide past vertical uprights, hence offering UE support along an entire length of parallel bars.

The assembly can variably be mounted by directly placing upon the rail, first removing and later replacing, a part encased in the housing.

An assembly is provided which offers unilateral UE support for lateral ambulation activities.

An assembly is provided which offers unilateral or bilateral static UE support. UE support assembly offers unilateral or bilateral mobile UE support.

An assembly is provided which can be made to glide with variable resistance.

An assembly is provided which can be (hand-) braked in order to cease movement of one or both housings along rail.

Assembly can be used bidirectionally, used for unilateral or bilateral UE support such that continuous walking can be performed, promoting endurance and gait training, and to encourage training in stepping turns in railed devices.

An assembly is provided which is functional irregardless of positioning relative to the body (in front of, or behind). This enables walking facing the opposite/reverse direction; this enables clinician access to the user from the front of the body, unencumbered.

An assembly is provided which offers bilateral UE support with UEs fixed in static positioning relative to each other. Proper posture, e.g. if forearm supports incorporated for this functionality; safety related to braking and variable resistance functionalities; continuous support advanced, such as for step to, three point gait, as can be accomplished with walkers, as opposed to discontinuous support involved when rails are necessarily gripped and released in order to advance.

An assembly is provided which offers bilateral UE support, whereby movement of one assembly, except for constraints placed in regards to maximum linear separation between assemblies, is independent of movement of the opposite support assembly. As such, the two UE support assemblies can function independently of each other.

An assembly is provided which facilitates reciprocating UE movement of one UE support assembly along one rail.

An assembly is provided which facilitates alternating placement of UEs as the user advances within the rails of a bilaterally railed device.

An assembly is provided which offers bilateral UE support, with limitation of maximum separation distance between assemblies (which offers a safety feature, and clinical benefit as excursion distance between placed UE supports can be variably set).

An assembly is provided which enables interchangeable UE support surface(s) in any combination: grip handle/forearm support; grip handle/grip handle; forearm support/forearm support. One can also envision introduction of other support surfaces such as axillary crutch support surfaces for crutch training within the safe confines of a bilateral railed device.

An assembly is provided which can be stably positioned on any of multiple devices with parallel rails.

An UE support device is provided which is intrinsically stable upon a device with two parallel rails, hence without the need for extrinsic stabilization.

An assembly which provides bilateral UE forearm support, with forearms statically positioned parallel to each other, and enables improved posture and gait kinematics compared to an alternative device offering statically positioned bilateral forearm support on a parallel rail device.

An assembly which provides bilateral UE support, whereby one or both of the support assemblies can be statically positioned on the rail for stationary activities, and when the user moves relative to the rails, the UEs can move independently of each other.

An assembly which enables training in gait patterns which can be continued with overground mobility aids which enable and facilitate the same patterns of UE movement.

Unilateral UE Support Designs

An assembly is provided which is mobile upon, and which can be stably positioned upon one rail of a railed device. As such, the device offers unilateral UE support when the user is facing or walking parallel to the rail(s) of the device. The housing (variably called the rail linkage assembly) is the component which is positioned upon the rail, which can glide bidirectionally, and which can be statically positioned upon, a rail. An UE support surface assembly is secured to the mobile housing to create a mobile UE support assembly.

UE support surfaces such as forearm support and grip handle can be interchangeably incorporated.

Rotational stability is provided by a stabilizing rail placed below the rail and a rigid interconnecting member connecting the mobile housing and the mobile component housed within the stabilizing rail.

Two design concepts are included. Variable resistance to glide and braking capabilities exist in both. Motion stop blocks delimit the translation range of the housing along the rail. This assembly can be incorporated onto both rails of a rail system with two rails such that both UE of a user can be supported when the user is positioned between the rails and facing parallel to the rails. When assemblies are used in this manner (one on each of two parallel rails), mobile assemblies can be interconnected with the crossover arm hinged linkage described above, if desired.

One can also consider other types of mechanical interconnections between mobile assemblies, which would offer various functionalities, such as reverse motion linkages, a horizontal rigid linkage, among others. When the user faces perpendicular to the rail, and with two support assemblies introduced to one rail, bilateral UE support is enabled for sidestepping activities.

Two alternate devices enabling a support assembly to stably glide along a rail which provides for unilateral UE support are presented as follows: a track secured to one rail, upon which an 'UE support assembly' glides; a stabilization bar extending from a mobile support assembly on one rail, to the second rail in a railed device with two rails. Also, mobile UE support can be accomplished without mechanical stabilization of the device on the rail; the user provides active muscular stabilization in order to keep the support assembly in an upright position.

An assembly is provided which provides for mobile forearm support on one rail of a railed device.

An assembly is provided which provides for a mobile grip support on one rail of railed device.

An assembly is provided to which other UE support surfaces (besides forearm support and grip handle support) can be secured in order to support other parts of a user's UE. An assembly is provided which provides for unilateral static UE support on one rail.

An assembly is provided which offers unilateral or bilateral UE support on one rail for side stepping activities. An assembly is provided, offering static unilateral UE support by motion stop blocks. An assembly is provided which can allow mobile UE support within a selected translation distance.

An assembly is provided which can be braked when additional stability is needed.

An assembly is provided which moves along rail with variable resistance. An UE support assembly is provided which offers unilateral mobile support, stabilized by a bar positioned below the support rail. An assembly is provided which glides along a track attached to a rail, and to which an UE support surface can be attached.

Forked linkage: an assembly is provided which provides unilateral UE support and is stable about one rail by incorporating a stabilizing member extending to the second rail of the device with two parallel rails. Unilateral UE support, unstabilized: an assembly is provided which can be used on one rail without mechanical stabilization components. The user provides active stabilization of the assembly in the upright position.

BRIEF DESCRIPTION OF THE DRAWINGS

FIGS. 18A-18E are cane handle designs and FIGS. 18F-18J are forearm support assembly designs.

FIG. 22 shows the right side assembly advanced, and so on.

DETAILED DESCRIPTION-CROSSOVER ARM DESIGN

Figure 1:
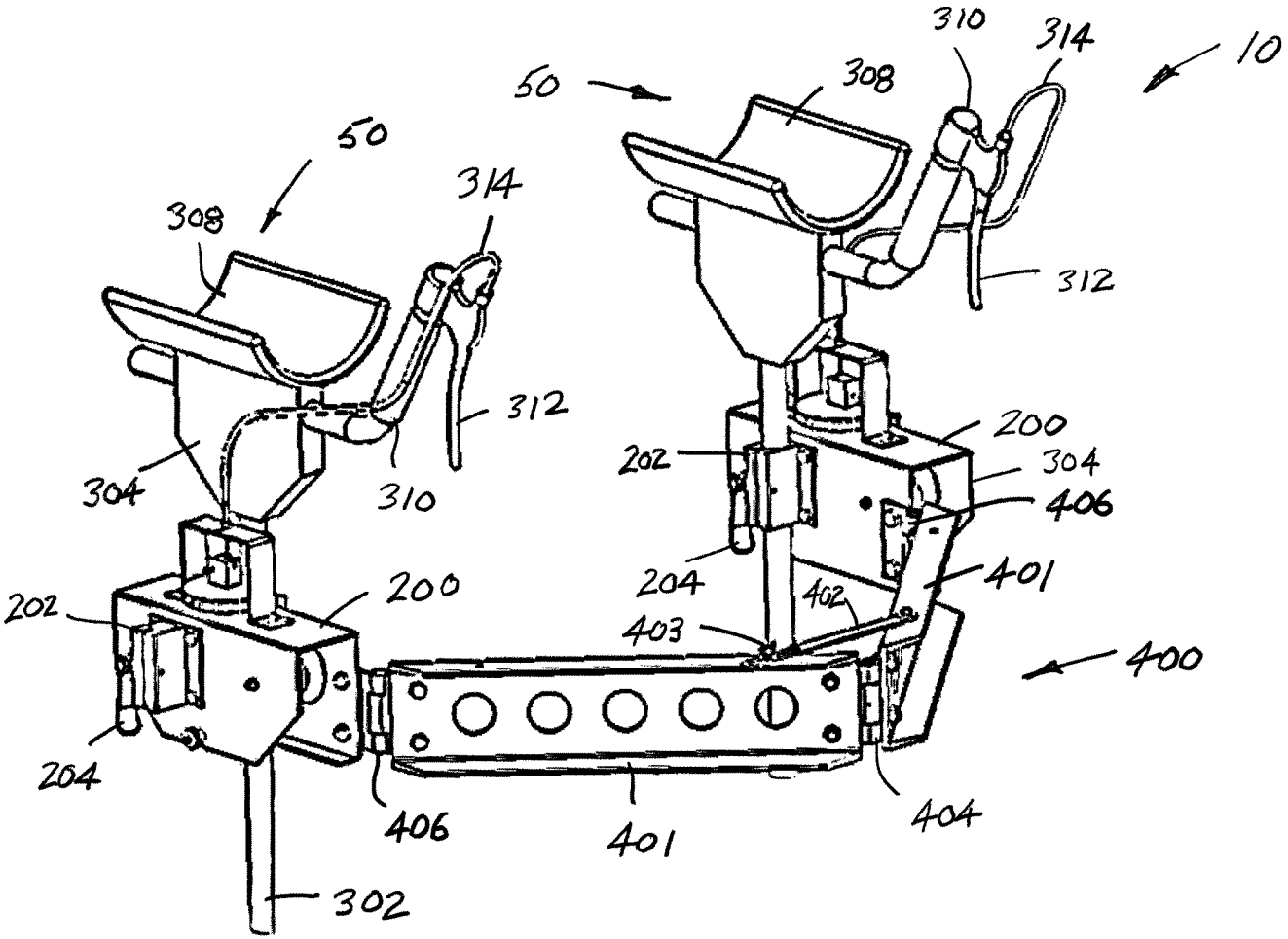
FIG. 1 is assembly with two forearm support assemblies mounted on each of two housings. Hinged crossover arms connect the housings.
Figure 2:
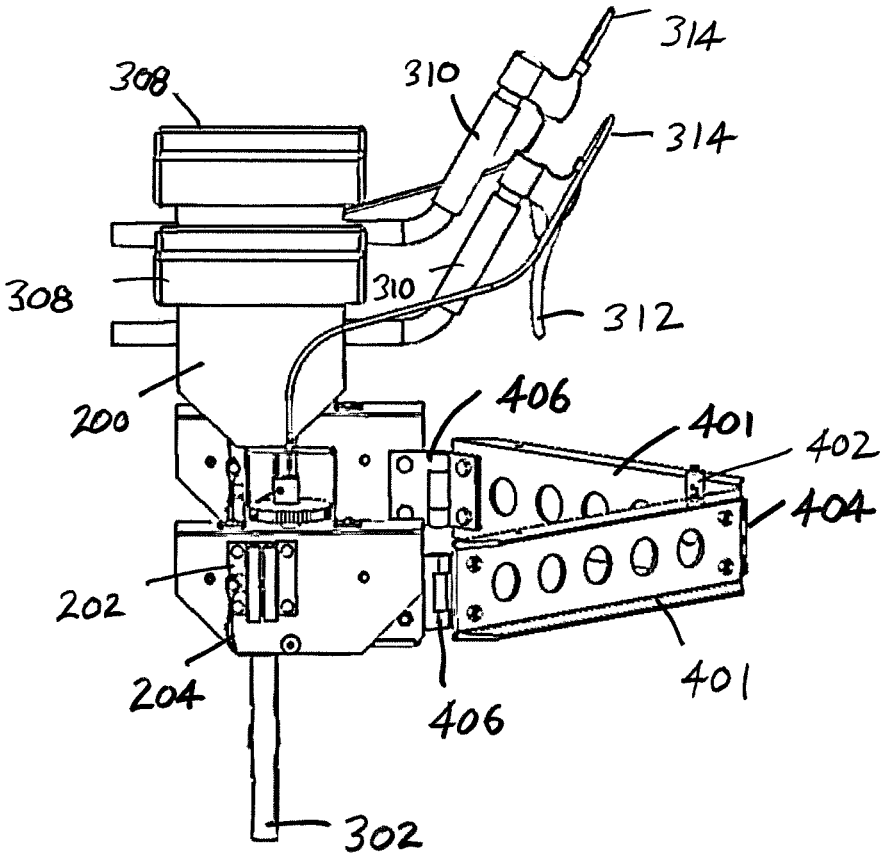
FIG. 2 is side view of assembly in FIG. 1.
Figure 3:
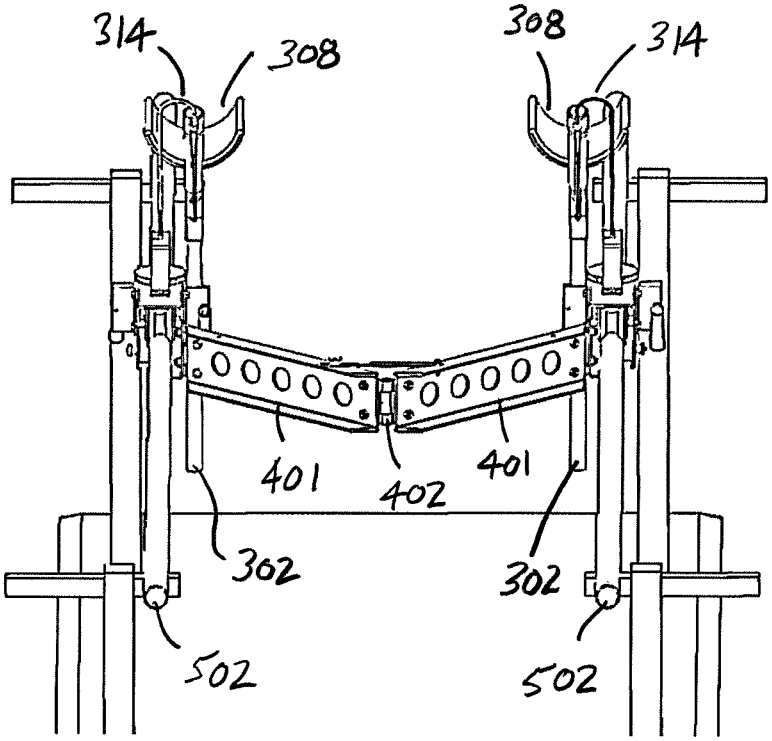
FIG. 3 is a frontal view of assembly in FIG. 1.
Figure 4A:
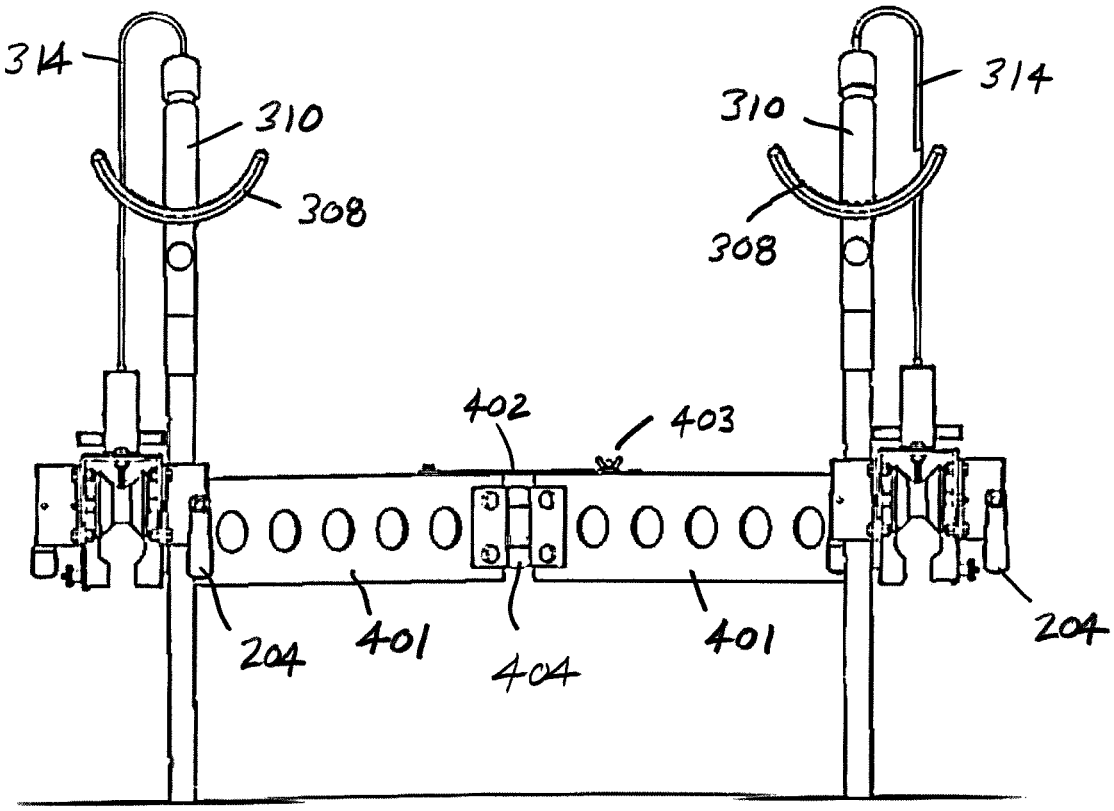
FIG. 4A is a posterior view of assembly in FIG. 1.
Figure 8:
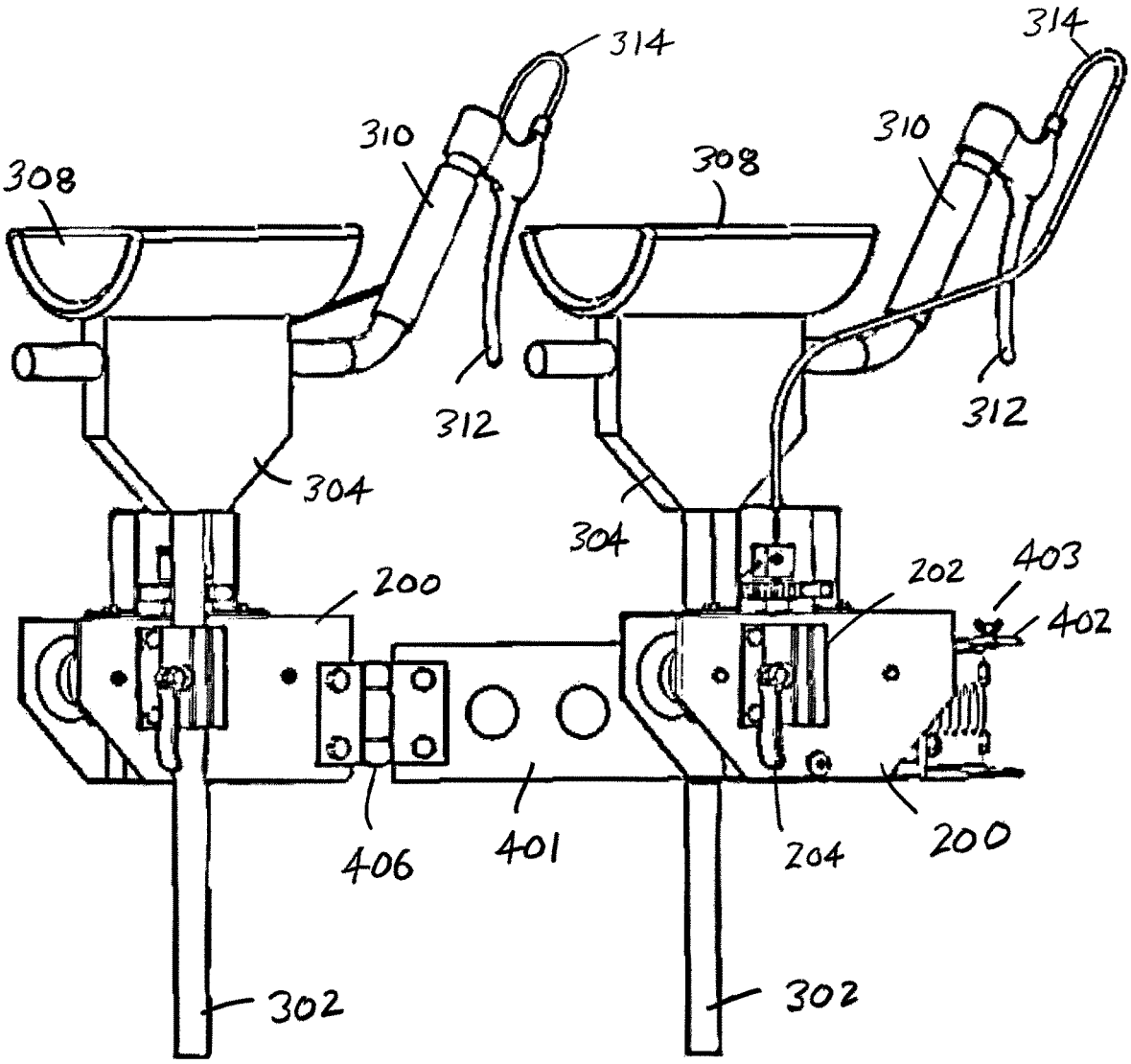
FIG. 8 is posterolateral view of assembly in FIG. 1.

An anterolateral view of the patient aid assembly or device 10 is shown in FIG. 1. A lateral view is shown in FIG. 2. A frontal view from above the device 10 is shown on FIG. 3, with the device installed on a parallel rail device 500 with two rails 502. A posterior view is provided in FIG. 4A and in FIG. 4B a posterior view of the device 10 which is installed on parallel bar device. FIG. 8 illustrates a posterolateral view of the same assembly. Two support assemblies or UE support assemblies 100 are included in the embodiment shown in the figures noted above, and both support assemblies are forearm support assemblies. Additional embodiments exist, as follows: for unilateral forearm support for walking in one direction, or for sidestepping, one may choose to secure a forearm support assembly 100 to one instead of to both housings 200; for unilateral forearm support for bidirectional walking, forearm support assemblies would be attached to both housings, facing in opposite directions; for bilateral UE support, other support surface combinations include two grip handle assemblies or one grip handle assembly and one forearm support assembly; also, for bilateral support, for walking in the opposite direction, such as with the crossover arms positioned posterior to the user's body, the support assemblies would be facing the opposite direction. It is understood that additional UE support surface options, besides forearm and grip handle, could be introduced, for supporting other parts of a user's UE.

A support assembly includes a housing (200) and a support surface (300). See FIG. 28. A forearm support assembly 300 includes a vertical support tube 302 extending from the body of the assembly 304. A grip handle tube 306 and associated grip handle 310 are secured to the body of the device and a forearm trough 308 is situated on top. A brake lever 312 is attached to the grip handle 310 and a brake cable housing 316 is in place.

Figure 11:
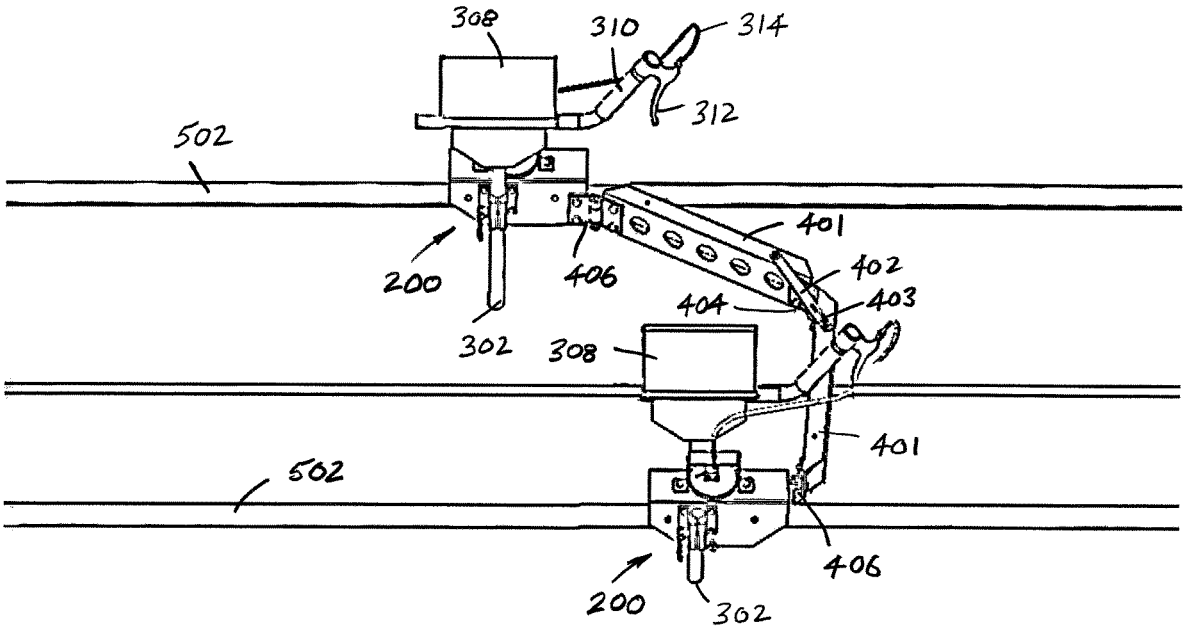
FIG. 11 is the assembly with housings asymmetrically placed upon the rails.
Figure 12:
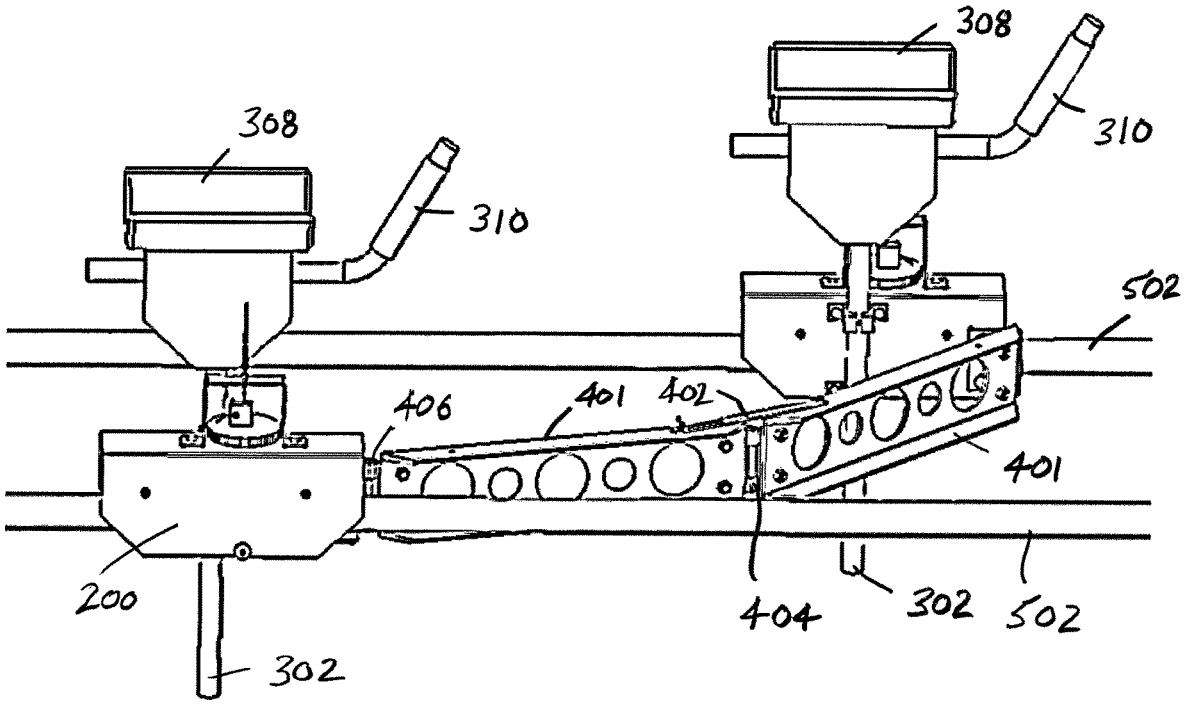
FIG. 12 is an assembly without brake levers incorporated into the housings, asymmetrically placed upon the rails. The linear distance between housings is greater than that shown in FIG. 11.
Figure 13:
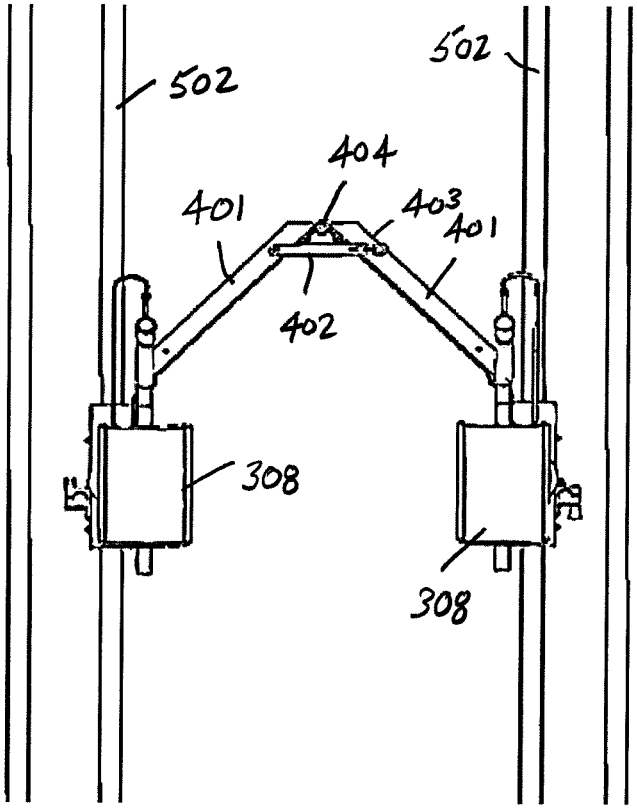
FIG. 13 omit is an overhead view of an assembly situated on parallel bars.

The two part crossover arm assembly or interconnecting member (400) preferably has two crossover arms or interconnecting member portions 401 connected at adjacent, distal ends by a central hinge 404. The assembly 400 can be statically positioned by securely positioning lock bar or link 402 which prevents movement at the central hinge 406 when thumbscrew 403 is tightened. A hinge 406 attaches each of the two housings 200 with each of two ends (proximal ends of the interconnecting member portions 401) of the crossover arm assembly 400. When the central hinge 404 is locked in a first condition of the lock bar 404 (i.e., the static position), a small amount of fore/aft movement of one housing with respect to the other is possible as related to the absence of hinge locks on the hinges 406 connecting the housings 200 with each of the two (proximal) ends of the two part crossover arm or interconnecting member portions hinged assembly. Locking mechanisms (not shown, but deemed similar to lock bar/link 402) could be readily introduced on these hinges if desired such that when the entire assembly is mobile upon the two rails, the housings remain statically positioned relative to each other. The supports 100 are positioned parallel to each other in the embodiment in FIG. 1. As the hinged crossover arms 401 enable movement of one mobile housing 200 with respect to the other mobile housing 200, the support assemblies 100 could also be asymmetrically positioned. Allowing movement at the central hinge 404 allows for movement of one housing 200 with respect to the other housing 200, such as would be needed in order to achieve the asymmetrical positioning of the two housings, such as presented in FIG. 11 and also in FIG. 12. Note that the forearm support assemblies 100 do not have brake levers in the embodiment shown in FIG. 12. FIG. 13 is an overhead view of an assembly 10 with support assemblies 100 slightly asymmetrically placed. In this example, all three hinges 404, 406 may be unlocked. Locking the central hinge 404, yet allowing movement at the hinges 406 between the housings 200 and crossover arms 401, results in a small amount of movement of one assembly 100/200 relative to the other. In FIG. 2, parts of the housing 200 are as follows. An arm support bracket 202 and associated locking lever 204 are placed medially and laterally on the housing 200. The positioning of the removal stop 206 and tightening bolt 207 are appreciated on lateral aspect of the housing 200. The removal stop 206 is located within the housing 200 and the outline is shown here for illustrative purposes. The brake cable 314 extends through the brake bracket 208 and through the cable clamp 210 which rests upon the parking brake knob 212.

Figure 4B:
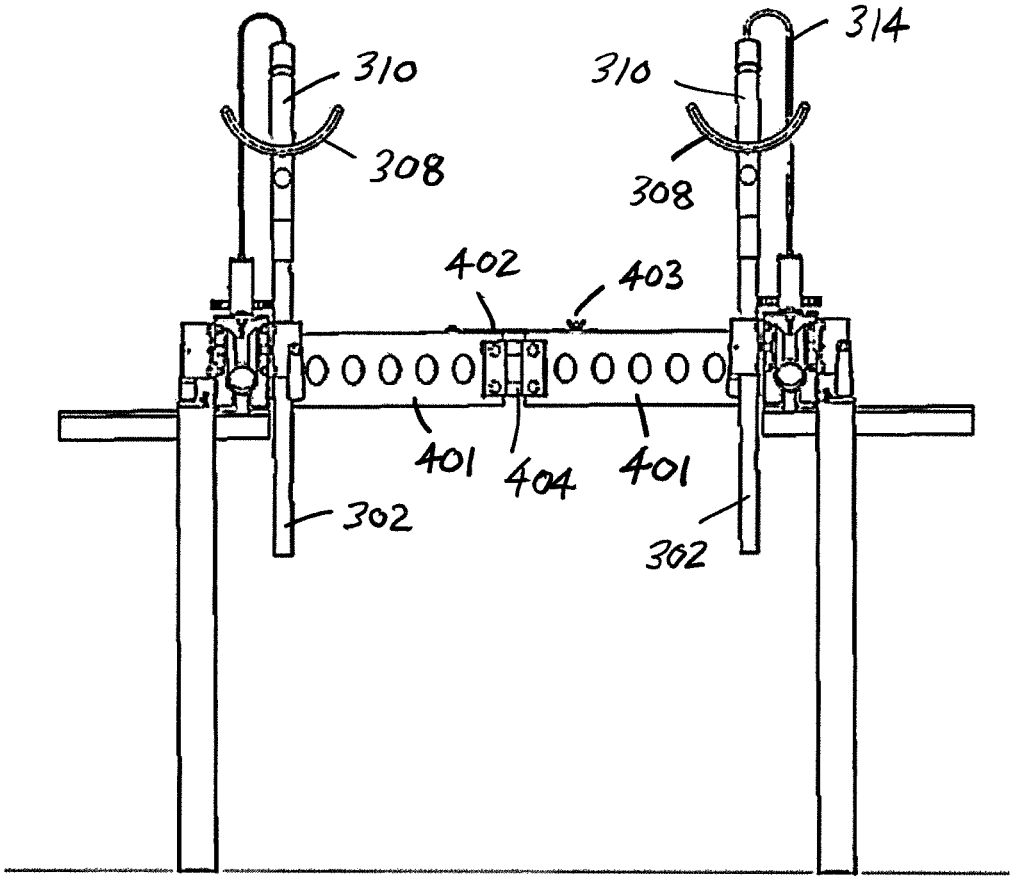
FIG. 4B is posterior view of the device illustrated in FIG. 3 with device positioned upon parallel rail device.

In FIG. 4B, the attachment mechanism of the rail to the supporting frame of the parallel bar device can be appreciated. This is one variety of methods used to connect a rail to the frame of the device. The design of the housing in the device presented herein accommodates this design, in that the housing can be installed on the rail by sliding the device over the end of the rail. This is possible due to the opening on the underside of the housing which accommodates the vertical peg 504 extending from horizontal frame member to the underside of the railing 502.

Figure 5:
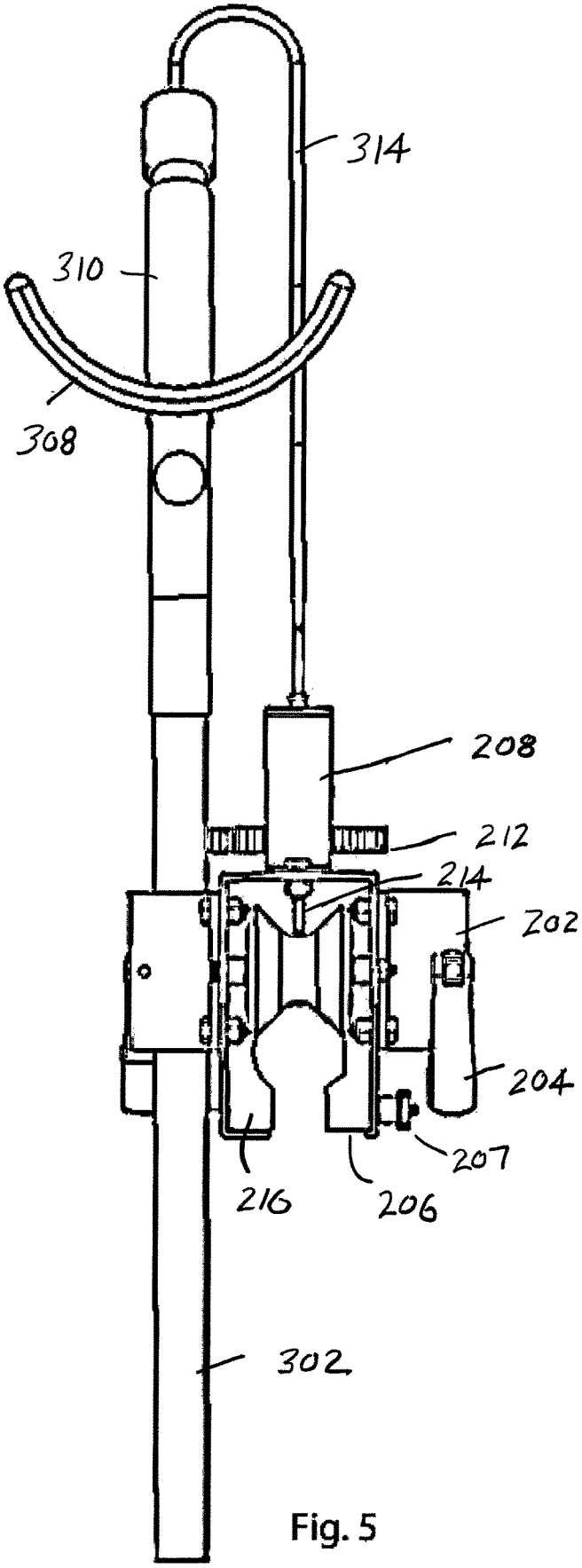
FIG. 5 is a posterior view of one support assembly. The hinged crossover arm assembly and rail has been removed.
Figure 6:
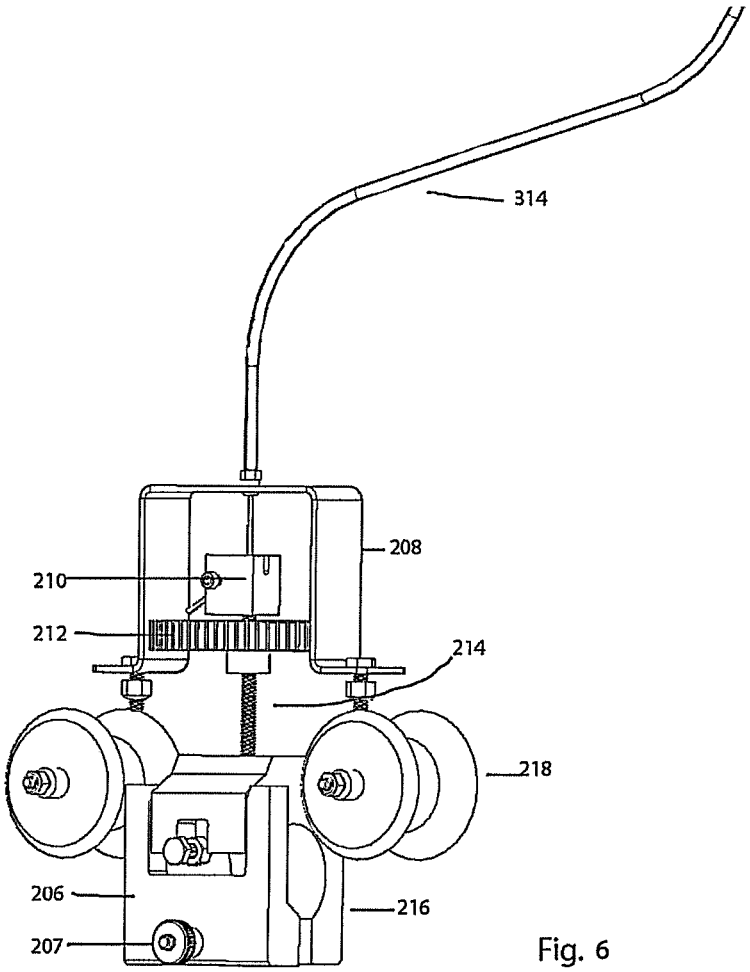
FIG. 6 is a view of FIG. 5 with the support surface and housing removed.
Figure 7:
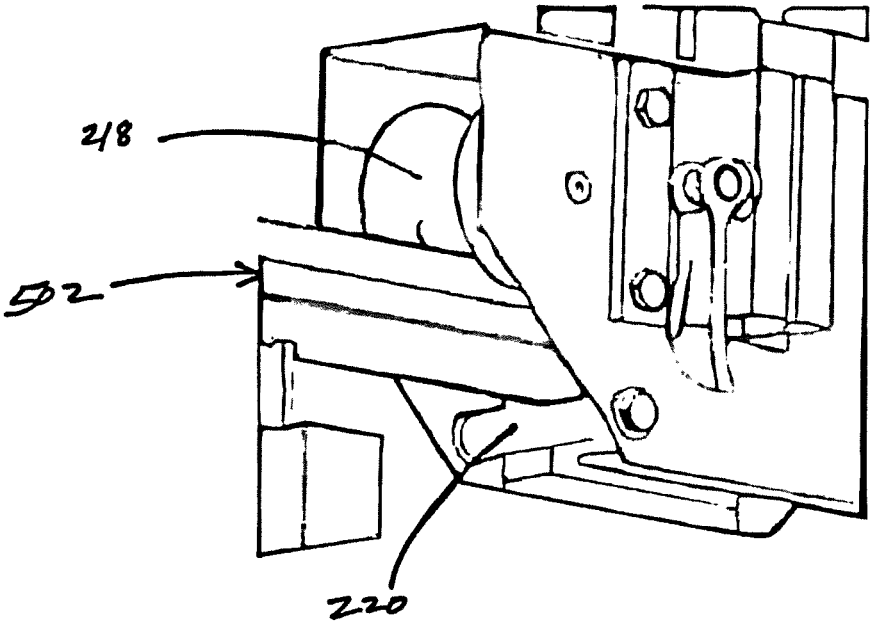
FIG. 7 is a close up view of a housing situated on a rail with the addition of a roller stabilizer.
Figure 9:
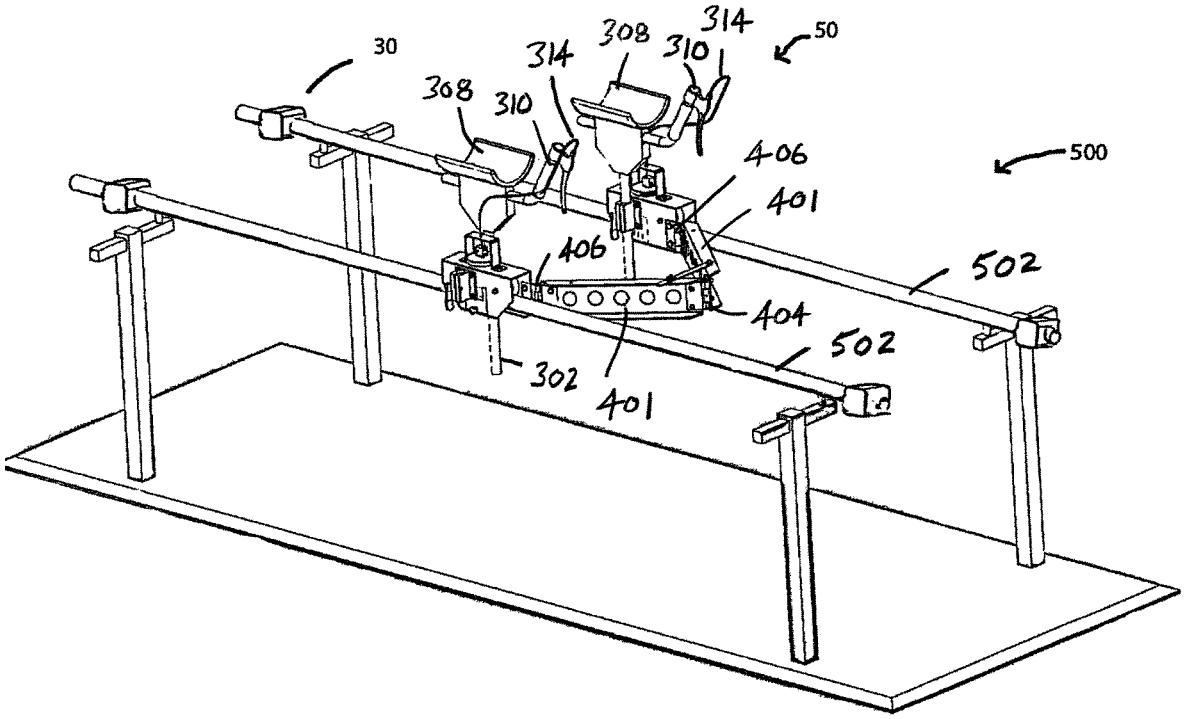
FIG. 9 is an illustration of the assembly in FIG. 1 situated on parallel bars.

A support assembly (housing and support surface) is shown in FIG. 5. The crossover arms have been removed. A long threaded bolt 214 is inserted up through a hole on (ceiling of) brake block 216, through hole in parking brake knob, and thence threaded into underside of cable clamp. Squeezing brake lever causes brake block to be elevated from resting position within housing, such that the lower margins of its arcuate surface make progressively greater contact with the rail, as brake is more fully engaged. Rotating the parking brake knob prior to use of the device enables positioning of the brake block in order to select the amount of resistance to glide. Maximal rotation of the parking brake knob causes the housing to be stably positioned about the rail such as desired when static UE support is desired. The resistance to glide can be adjusted by rotating the brake control knobs and can be adjusted for symmetrical or asymmetrical resistance to glide as desired. The removal stop 206 serves to properly position the brake block in vertical orientation and keeps housing assembly secured about the rail. Track wheel 218 is shown in FIG. 5 and both track wheels shown in FIG. 6. This embodiment (a single support assembly, without crossover arms) could be incorporated for use as a static unilateral forearm support. This would be accomplished by fully engaging the parking brake knob. In the event that unilateral (e.g. left side) static forearm support was desired, such as might be the case for treadmill use by a stroke patient with moderate UE weakness, the second (right side) housing could be statically positioned more anteriorly upon the rail, crossover arm assembly and lock bar locked in place, enabling the user to grip the second rail with the stronger right hand if this desired. Installation of both assemblies with crossover arms intact enables progression to mobile UE support on a railed device, as the hinged linkage stabilizes the housings upon the rails. The lock bar would be released, enabling movement of the left assembly. Support and movement of the right UE would be enabled by releasing the parking brake knob, and placing the UE on the selected support surface (forearm or grip handle). In FIG. 6, the support surface and housing have been removed for ease of illustration, and as such, the inner components of the housing are shown which include the brake block 216, two track wheels 218, and removal stop 206. FIG. 7 is a close up view of one housing resting on a rail. A roller stabilizer 220 has been added and offers additional stabilization of the housing upon the rail when this is desired. This component is a third point of contact with the rail, along the underside of the rail. FIG. 9 illustrates the device in FIG. 1 mounted on a parallel rail device. Motion stop blocks 30 are positioned at both ends of both rails. These are statically positioned housings which prevent a mobile housing from gliding off of a rail and are attached to the rails after the housing(s) are mounted, if mounted by sliding the housing over the end of the rail. If the housing is mounted at any point along the rail between the vertical support members of the rails (and thus between the attachment points of the rail to the railed device frame), the motion stop blocks can be installed before the assembly is mounted.

Figure 10:
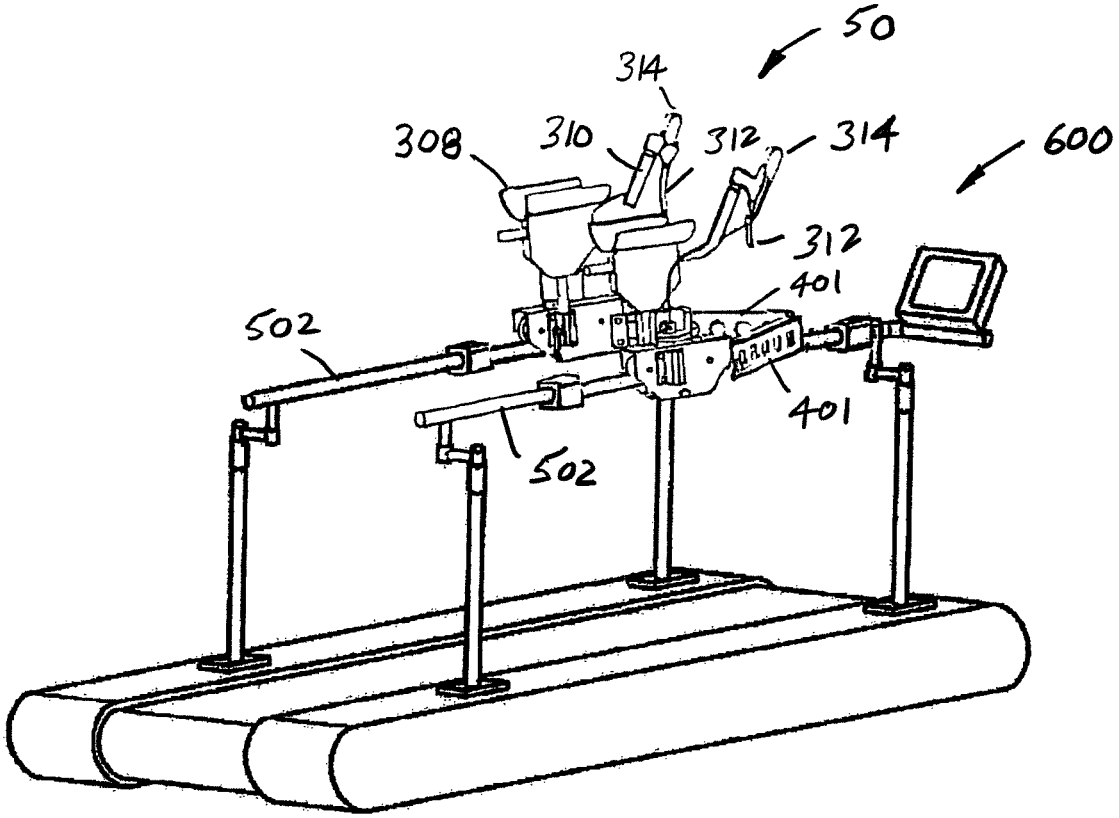
FIG. 10 is assembly in FIG. 1 situated on treadmill.

FIG. 10 illustrates the device in FIG. 1 mounted on a treadmill with side rails. Motion stop blocks 30 are positioned on the open rail ends to prevent either of the two mobile housings from gliding off of the rail. Of course, when a support assembly is statically positioned in order to provide static UE support, a motion stop block(s) would not be needed.

Figure 14:
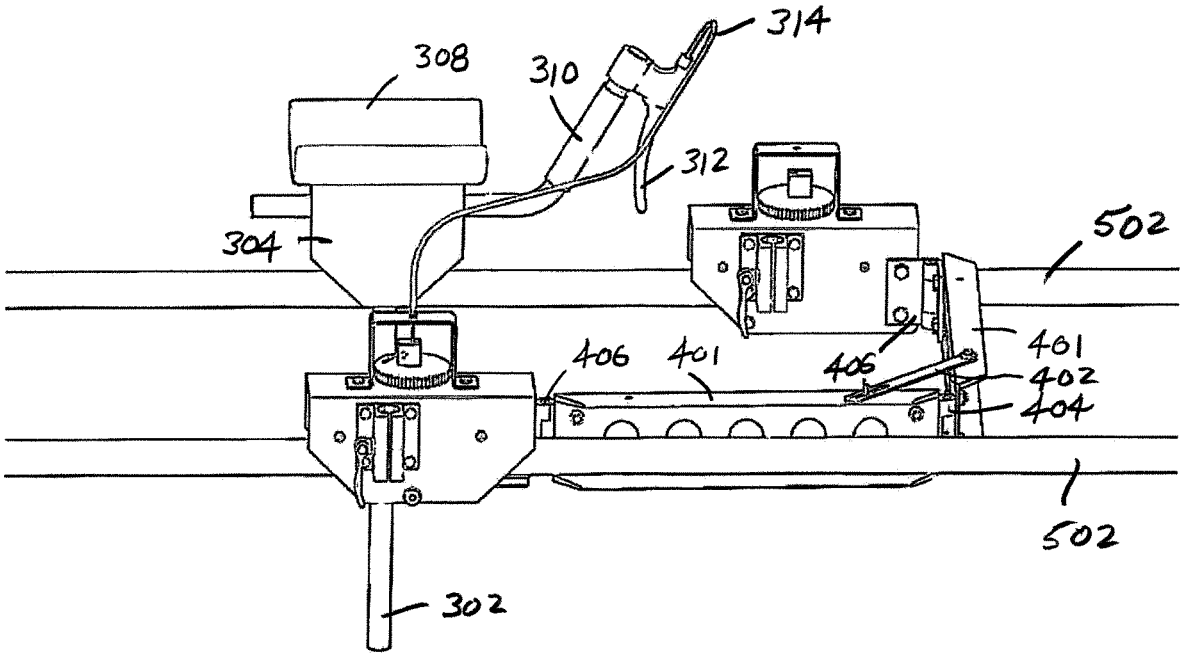
FIG. 14 is an illustration of one housing advanced further than other housing, with a support assembly, particularly a forearm support assembly, on one side. This embodiment provides for unilateral UE support.
Figure 15:
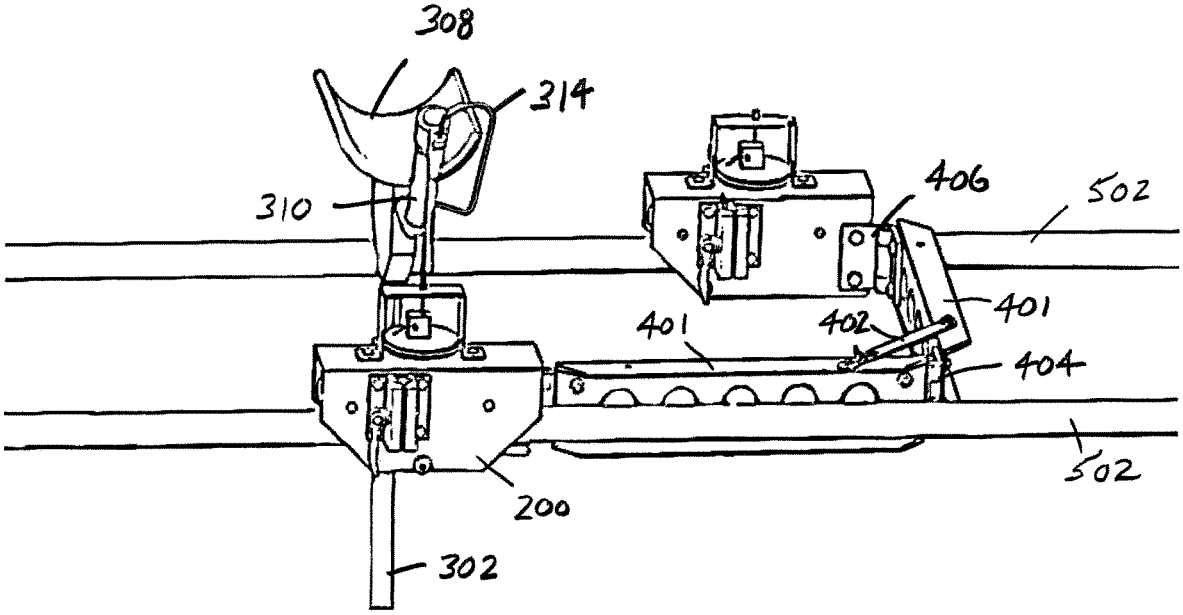
FIG. 15 is an illustration of an embodiment which would be used for side stepping activities. A support assembly is provided on one rail. The housing on the opposite rail is positioned so as to accommodate positioning of the user's body, and the central hinge is secured in static position. This embodiment provides for unilateral UE support.
Figure 16:
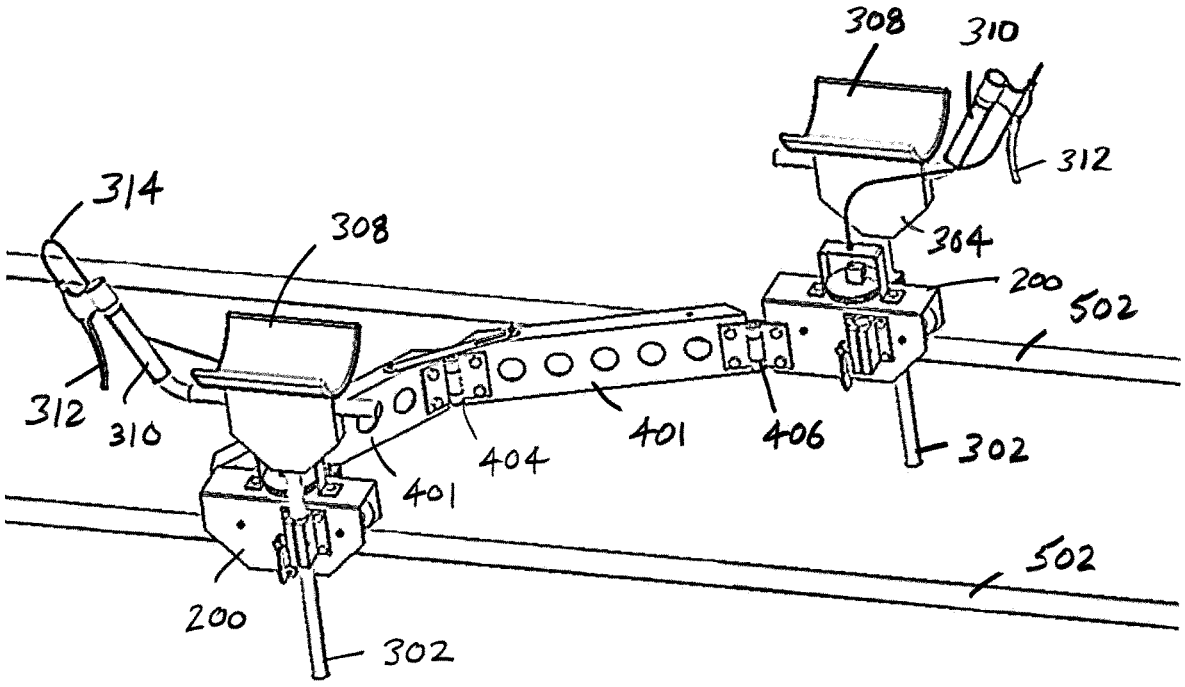
FIG. 16 illustrates two support assemblies facing opposite directions such as would be done for user requiring left sided forearm support in this example. This embodiment provides for unilateral UE support.

FIGS. 14-16 illustrate embodiments offering unilateral UE support. In FIG. 14, a forearm support assembly is mounted on the housing positioned on the first or lower rail (as pictured). The brake cable has been removed from the second housing and the second housing does not have a support assembly attached. With this configuration, the user can place a right forearm on the forearm trough and grab the second rail with the left hand. The housing on the left (uppermost as illustrated) rail is advanced and the lock bar tightened in place. As the user steps forward or backward between the rails, the housings remain statically positioned relative to each other and slide together (in unison) along the respective rails. This embodiment enables unilateral forearm support for side stepping activities as follows. The vertical support tube of the forearm support assembly is rotated 90 degrees in the tube clevis. If desired, the second housing on the second rail can be moved to the left as pictured in this illustration. This would create more room between the assembly arm and the first rail for easier access by the user. It would also enable greater walking distance toward the right, as pictured in this illustration, as movement would not be restricted as soon by the second housing approaching the end of the second, upper rail.

The forearm support assemblies are facing opposite directions, in the embodiment shown in FIG. 16. This is accomplished by loosening the levers on the arm support brackets, rotating the vertical support tubes 180 degrees within the tube clevises, and tightening the levers. This configuration provides for left sided forearm support. The user places the left forearm on one support assembly and can either grab the opposite rail or allow the opposite UE to be unsupported. As indicated, the crossover arms can be either anterior to or posterior to the user's body. In this example, when walking toward the left as seen in this illustration, the opposite assembly could be positioned anterior or posterior to a point directly across from the assembly offering support. The central hinge may be locked or unlocked. If the central hinge is locked when walking, it must be unlocked before or after the user turns to face the opposite direction, depending on access (i.e., if facing the crossover arms or facing away from the crossover arms, respectively). It is unlocked in order to reposition the assembly arms relative to one another as desired. Relative positioning of the support assembly not to be used for walking in one direction determines how far the user can walk, as related to if unused assembly is positioned in front, walking must be stopped when the housing reaches the end of the allowable translation distance along the rail. Positioning of the second housing also impacts access of the user's gripping hand to the second rail. When bilateral UE support is desired, support surfaces can be installed on housings in any combination.

Figure 17A:
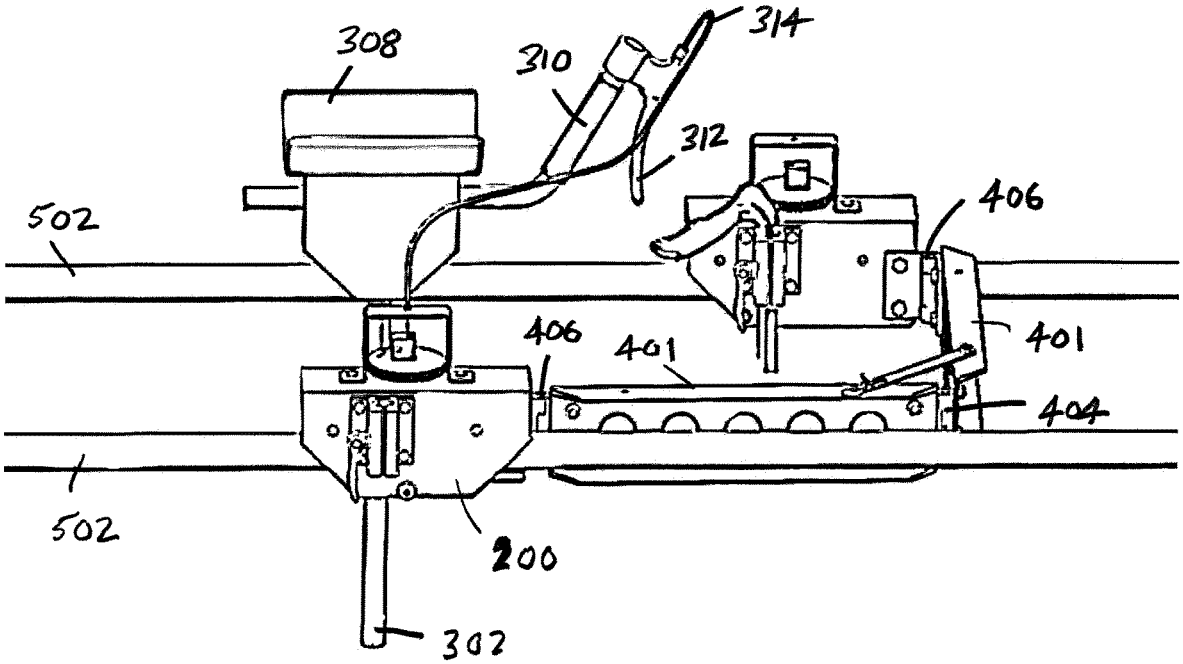
FIG. 17A illustrates an embodiment offering bilateral UE support, incorporating one grip handle assembly and one forearm support assembly.
Figure 17B:
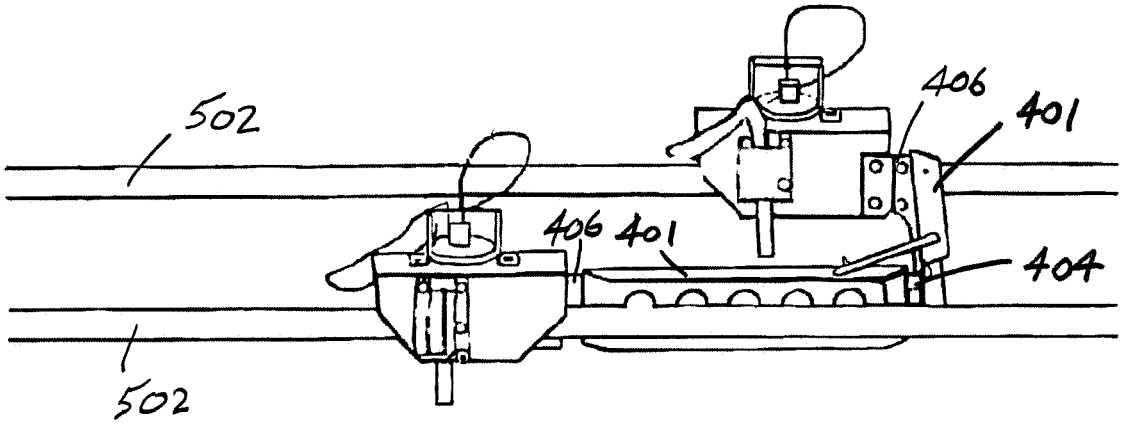
FIG. 17B is an illustration of an embodiment which provides for bilateral UE support, incorporating two grip handle assemblies.
Figure 18A:
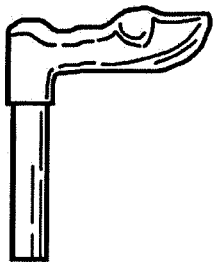
FIGS. 18A-18J are examples of UE support surface assemblies, specifically.
Figure 18B:
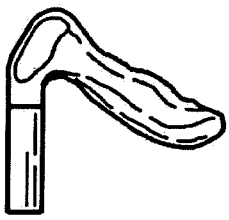
Figure 18C:
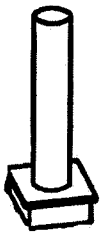
Figure 18D:
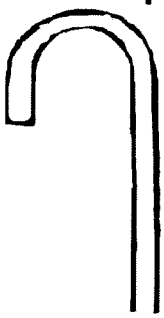
Figure 18E:
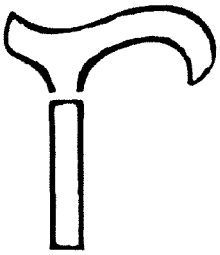
Figure 18F:
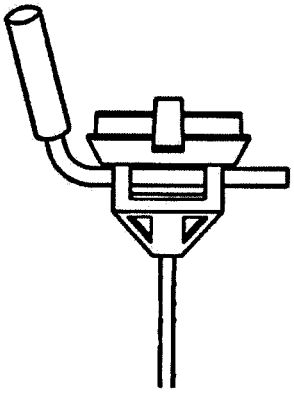
Figure 18G:
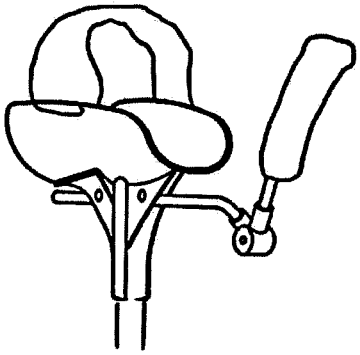
Figure 18H:
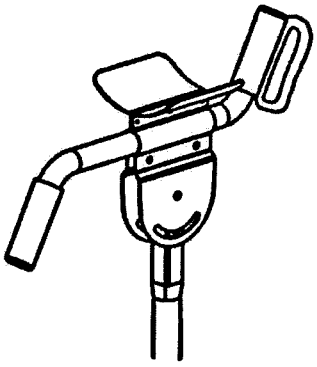
Figure 18I:
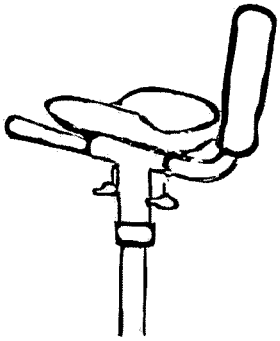
Figure 18J:
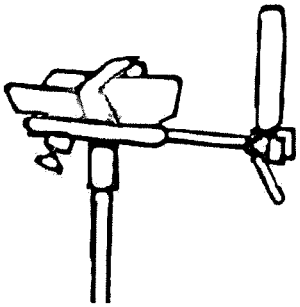

Various examples of cane handle assembly and forearm support assembly designs are shown in FIGS. 18A-18E and FIGS. 18F-18J respectively. One forearm support assembly and one grip handle assembly are shown in FIG. 17A. A brake lever and brake cable are not integrated into the grip handle assembly. This combination of support surfaces may be desirable, for example, if a user has a strong limb which could grip one rail, and a weaker limb requiring forearm support, yet the continuous mobile support offered to the gripping hand as opposed to gripping and releasing facilitates training in any of several ways. In the absence of a brake lever on the grip handle in this example, the stability offered by a gripped hand directly on the rail may be preferable to a mobile grip handle assembly. Two grip handle assemblies are shown in FIG. 17B. Note that brake cables are illustrated in FIG. 17B, yet these are not attached to the grip handles which do not have brake levers. It would be desirable to have brake cables in place on a mobile housing, for attachment to brake lever arrangement on any support surface which might be installed and which has a brake lever. One can also consider that one or two axillary crutch support assemblies could be attached to one or two housings for training in axillary crutch ambulation.

Figure 19:
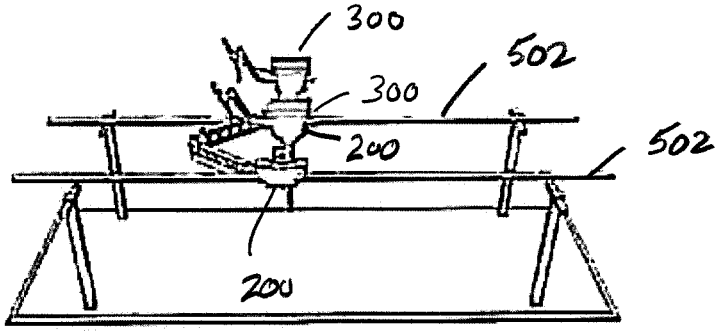
FIGS. 19 and 20 provide illustration of an embodiment including support assemblies statically positioned relative to each other, at two points in time occurring as a user advances right to left between the rails. This static positioning is variably enabled by securing the Lock Bar in place or by the user actively maintaining the supports positioned in parallel.
Figure 20:
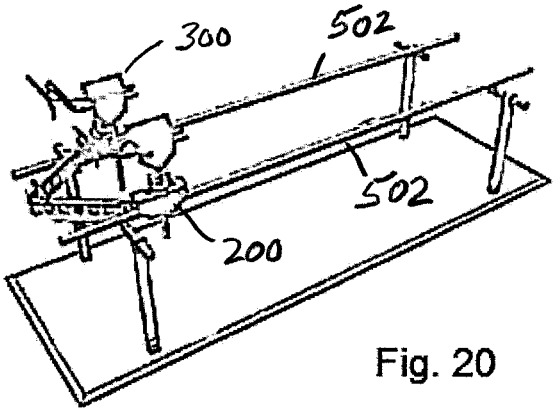
Figure 21:
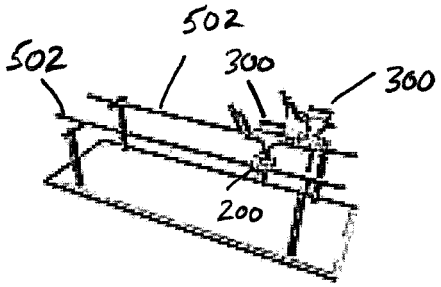
FIGS. 21-25 are illustrations of sequential advancement of mobile forearm support assemblies. The left side assembly is shown in an advanced position in FIG. 21.
Figure 22:
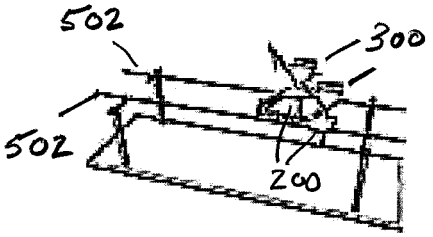
Figure 23:
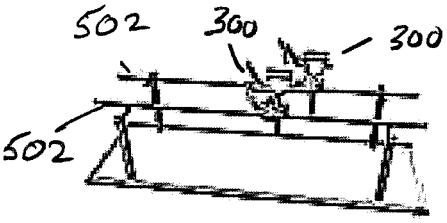
Figure 24:
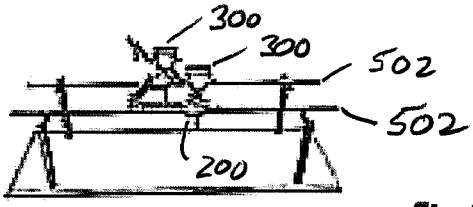
Figure 25:
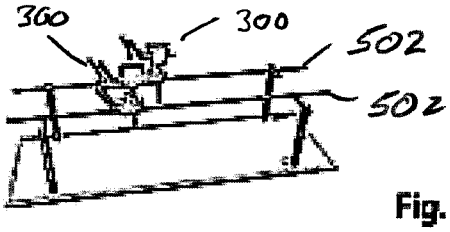

FIGS. 19-20 illustrate positioning of the entire assembly on the rails at two different points in time, such as would occur if the user walks from right (FIG. 19) to left (FIG. 20) as pictured, with the central hinge locked or if user otherwise maintains the arms parallel to each other. The entire assembly is preferably kept in the same position relative to the body, when the user performs continuous stepping. This device in particular offers a means to achieve correct posture when bilateral forearm support is provided on a railed device. Static positioning of the forearm supports relative to each other, such as with the central hinge locked, could also be incorporated for training in a step to gait pattern, whereby the UEs are advanced together, followed by stepping with each foot in turn. The hand brakes could be engaged as needed. As opposed to current step to gait training in parallel bars, the resulting gait pattern would be similar to that performed overground with a standard walker or rollator. This would be desirable to train with the same technique which will be performed overground. Static positioning of two symmetrically placed forearm support assemblies upon a railed device would be accomplished by fully engaging the parking brake knob(s). Various functionalities are provided for when the central hinge is unlocked, enabling independent movement of one assembly relative to the other (albeit with the restrictions imposed by the maximum linear separation between assemblies, related to rail width and length of assembly arms).

The user can advance the support assemblies in alternating fashion, as sequentially illustrated in FIGS. 21-25. In this example, as related to consistent positioning of an assembly during advancement of the second assembly, the user engages hand brakes or actively maintains the assembly in static position. Engaging the hand brake following advancement of an assembly would be particularly useful in cases in which a static stable support surface is desired, in order to advance the opposite lower extremity. Upon reaching the left side of the rails as pictured, reverse direction ambulation (i.e. left to right as pictured) is enabled by rotating the support surfaces 180 degrees and user performs a stepping turn to face toward the right. The crossover arms are thence positioned posterior to the user's body as walking is performed from left to right within the rails (i.e., in reverse sequence).

Figure 26:
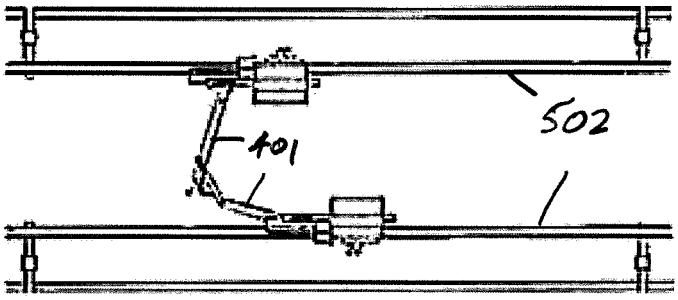
FIGS. 26 and 27 are illustrations of the assembly with the right assembly advanced (FIG. 26) and with left assembly advanced (FIG. 27), such as would occur if the user was standing or marching in place and performed reciprocating, out of phase movement of the UE.
Figure 27:
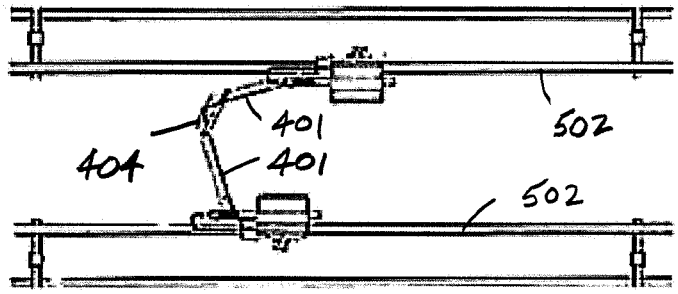

FIGS. 26 and 27 illustrate positioning of the two support assemblies which would occur if user was standing in place and moving the arms out of phase (i.e. reciprocating arm movement). The user could also move the arms in this manner concurrent with walking forward or backward between the rails.

Function of Crossover Arm Design Assembly:

This entire assembly can be mounted on the rails by sliding both of the two housings with removal stops intact over the ends of the two rails, with the two part linkage intact. Alternately, with linkage intact, the housings can be held by the brake brackets, and with removal stops removed, lowered onto the bars. The removal stops are replaced to complete stabilization of the housings about the rails. Variably, the entire Assembly can be installed as follows: with hinged linkage removed, each of the two Housings in turn can be statically mounted on respective rails, either by gliding over the end of rail or by mounting directly onto the rail, as described above. The intact two part Crossover Arm assembly is secured in place between the two housings by engaging the hinge members on either end with the hinge members on each of the two housings. Variably, one or two housings with support surface(s) attached can be used for static support, and as such, the crossover arm assembly would not be needed for stabilization of housing(s) about the rail. One or two mobile assemblies can be used without the crossover arm assembly, this requiring the ability of the user to maintain the assembly in an upright position. One or two support assemblies, in any combination, are installed by positioning the Vertical support tube within either the medially or laterally placed arm support bracket, and adjusting the support surface height, for desired form, fit, function. The support surface(s) can be readily rotated 180 degrees for UE support walking in opposite direction. Sidestepping with forearm support, for example, is enabled by having the support surface on one side, and rotating the support surface 90 degrees. With the central hinge unlocked, the width of the parallel bars is adjusted for form, fit, and function. If hinges between linkage and housings also are equipped with a locking mechanism, this would be released prior to adjusting the parallel bar width. Note that adjusting the rail width may be desirable in order to change the maximum linear separation distance between assemblies. Increasing the width results in a decreased distance along the rail that one housing can move with respect to the other. Of course, adjusting rail width impacts fit and function related to UE positioning, yet this can be offset by variably attaching the vertical support tube of the support surface in the medial or lateral arm support bracket. Variable resistance to glide of the housing along rail is set by turning brake knob. If the device is used for unilateral support functionality, or for bilateral support with support assemblies statically positioned relative to each other, the resistance to glide is symmetrically set on each of the two housings. When the assembly is used for bilateral support and the central hinge is unlocked such that the two support assemblies can move independently, one might chose to set a greater resistance to glide on one housing as compared to other, depending on training objectives. Unilateral UE support, incorporated when the user wishes to either grab the opposite rail or allow the opposite UE to be unsupported, is achieved as follows. The assembly arms can be anterior or posterior to the user for use in parallel bars, and for safety reasons preferably anterior to the user if used on a treadmill. If anterior, initial set up is as follows. A support surface is selected and attached to a first housing. The second housing is advanced a selected distance on the rail. For static UE support, the parking brake knobs would be engaged on both housings and one UE supported and the opposite UE grabbing rail or hanging freely. For mobile UE support for stationary activities in parallel bars or for walking on a treadmill, the central hinge unlocked, allowing movement of the crossover arms, and the supported UE would be freely mobile while the housing without a support assembly would be statically positioned by engaging the parking brake. For walking in parallel bars, the central hinge would be locked with the housings asymmetrically positioned such that the user could grab the rail with the opposite hand or allow the uninvolved UE to hang freely, and both housings being free to move upon the rails. A support surface facing the opposite direction is attached to the second housing in the event reverse direction walking will be performed. The user can walk forward in the reverse direction as follows: upon reaching the end of the parallel bars, the central hinge is unlocked such that the crossover arms can be repositioned as needed to enable the user to perform stepping turn and replace the UE on support assembly on the opposite rail. The lock bar on the central hinge is secured. Upon reaching the end of the parallel bars, the user turns to face the opposite direction, and replaces the UE on the first support assembly and again positions the second mobile assembly to enable gripping of the rail as described above.

Lateral stepping is performed by rotating the vertical support tube 90 degrees such that the user can face laterally. A support surface would not be needed on the housing on the opposite rail, and this second housing is positioned as desired and central hinge can be locked if desired. The assembly arms are positioned to enable proper positioning of user's body.

The crossover arm design assembly can also be used on hemiplegic bars for unilateral UE support. With the removal stops removed, the entire assembly is lowered into place onto the rails and the removal stops replaced. The central hinge is locked. One support assembly is attached to one housing, and unidirectional, unilateral UE support is enabled.

Bilateral support functionality is as follows. UEs can be statically positioned relative to each other during walking, with the central hinge locked. As the current design does not provide for a locking mechanism on hinges between housings and distal ends of crossover arms, a small amount of linear displacement between housings is possible with this configuration. If grip handle support is on one side and forearm support is on the other side, or for other various physical or functional reasons, it may be desirable to have the support assemblies positioned asymmetrically, that is, not parallel to each other, when the central hinge is locked. Alternately, the supports can be symmetrically placed. The user can walk with the one piece entire assembly statically positioned relative to the body, such as with step through gait, and that which can be performed walking in parallel bars or on a treadmill. On a treadmill, the brakes on the housings would be engaged, and the user would maintain consistent positioning of the body with respect to the UE support assembly. Also, the assembly can be advanced, braked or otherwise kept in fairly static positioning without engaging the hand brake, followed by one foot and then the other. This is a step to gait pattern which could be performed in parallel bars or on a manual treadmill. The crossover arms can be positioned anterior or posterior to the user's body. When changing walking direction, the support assemblies are rotated 180 degrees by rotating the vertical support tube within the arm support bracket. The user performs a stepping turn and replaces the UEs on the support surfaces. Bilateral functionality when central hinge is unlocked is as follows. The two housings can move independently of each other within the constraint of maximum linear separation posed by the interconnecting member (crossover arms). The length of the assembly arms and distance between rails determines the maximum linear separation one can achieve between assemblies, such as may come into play if grip handles are incorporated and the assemblies are moved out of phase as occurs during arm swinging. Each of the two assemblies can be mobilized in the direction and to the extent desired, when linkage is unlocked. The unlocked crossover arms can be posterior or anterior to the user's body. The support surfaces are rotated to face the appropriate direction as described above, upon changing walking direction. For use in parallel bars, the support assemblies can be advanced alternately as user walks. Alternating placement of the UEs is performed when walking with a two point gait or four point gait. If hand brakes are used, each assembly moves in one direction along its rail. If hand brakes are not used, some movement in the reverse direction can occur as the opposite UE is advanced.

For treadmill training in two point gait, which involves out of phase UE movement, with each UE providing support for its opposite lower extremity (LE), the support assemblies are alternatingly advanced. Hand brakes may be used or not used. For treadmill training on a manual treadmill, that is a treadmill with a belt that is not driven by a motor, four point gait can be performed for the first time on a treadmill as follows. A first UE is advanced, followed by the opposite LE, then the second UE followed by the LE opposite. Four points of contact are made. Use of the assembly for bilateral support also enables the user to freely move the support assemblies to and fro on one or both rails, while standing in place or while walking, to the extent desired or to the extent the user is able to move the arms. This could be accomplished using forearm supports or grip handle supports. Variably, one UE can stay positioned relative to the body as the body advances, while the other UE moves, depending on UE functional status or training objectives. Also, a user may move one UE to a greater extent than the opposite UE. A user may be minimally able to move one UE while walking, while able to advance a stronger limb a greater distance or move it in reciprocating fashion to a greater extent. A mobile central hinge enables this.

For use on a treadmill or for stationary activities in parallel bars, one assembly may be statically positioned by fully engaging the parking brake knob, while the opposite assembly remains freely mobile, allowing movement of that UE. In order to perform a two point gait, whereby the user advances an UE and the opposite LE at the same time, the extent of movement of the opposite UE in a direction opposite of the advancing UE would depend on functional status, gait technique, among other things. The opposite UE may move out of phase with respect to movement of the first UE, or it may move between the resting neutral position and an advanced position, as opposed to back and forth within the full range of motion anterior and posterior to the frontal plane of the body. Mobile grip handle support assemblies could in particular facilitate training in arm swinging, reciprocating UE movement. This may be needed, for example, for individuals with impaired gripping ability, such as those afflicted with spinal cord injury, training in a railed environment with deweighting technology such as body weight support or robotics, or other.

The continuous mobile support, with orthoses as needed to secure a gripped hand to the gripping surface, could be incorporated. This would facilitate arm movement, important for neurologic facilitation of the lower extremities, for biomechanical reasons, for UE rehabilitation, among other reasons. The linear separation between support assemblies is dependent upon the length of the crossover arms, as well as the width between the rails. The linear separation decreases as rail width increases. Beyond a certain midpoint in the range, however, narrowing the rail width results in increasingly less linear distance allowed as one assembly is advanced upon one rail. The rail width is adjustable on the majority of railed devices such as parallel bars and treadmills. The distance that one support assembly can be moved relative to the second support assembly can be adjusted by adjusting the width between the two rails. This may be done for safety reasons. Mechanically adjusting arm movement distance may also be done to alter gait kinematics and kinetics. Mobile UE support assemblies and particularly the device presented herein, facilitate training in proper gait kinematics across the spectrum of disability. The assembly facilitates alternating advancement of UEs and reciprocating (out of phase) UE movement, as related to the design (the assembly arms visually facilitate alternating and reciprocating UE movement) and mechanically, as related to the restriction in the maximum separation distance between mobile assemblies. For example, with a first assembly statically positioned by hand braking, the opposite second assembly is advanced until limited by the length of the crossover arms, and subsequently braked, and the brake on the first assembly is released such that it can be advanced.

Unilateral UE Support Designs

Figure 28:
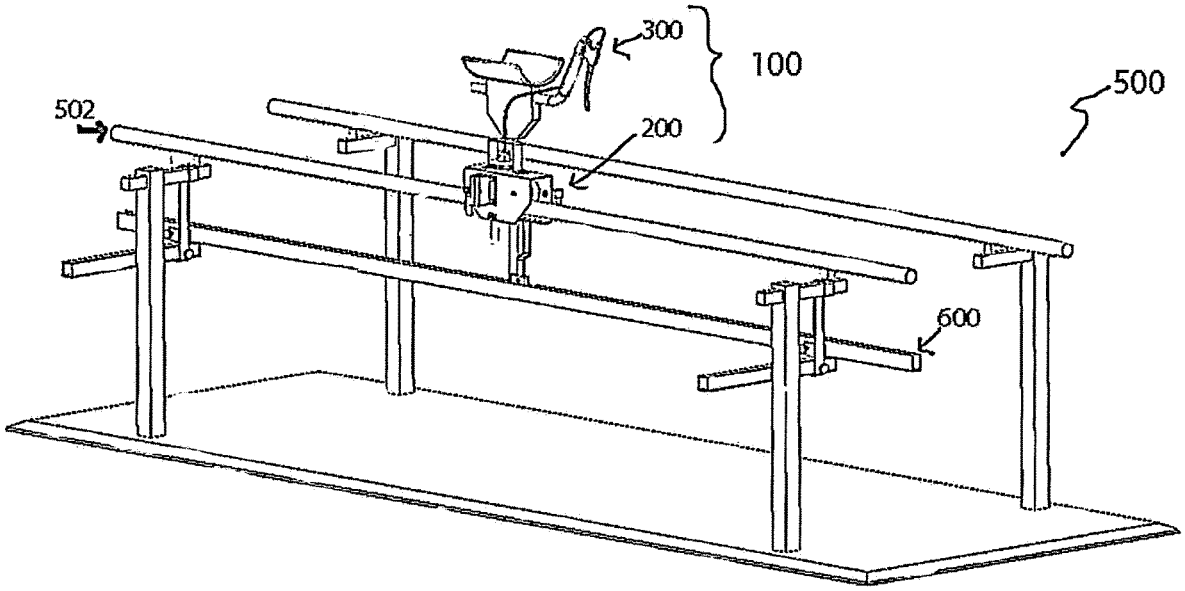
FIG. 28 is a railed device system (Unilateral System #1) shown on a parallel bar system, offering unilateral UE support with a stabilizing rail (e.g., U channel) secured to railed device frame via a Hanger and U Channel Brace.
Figure 29:
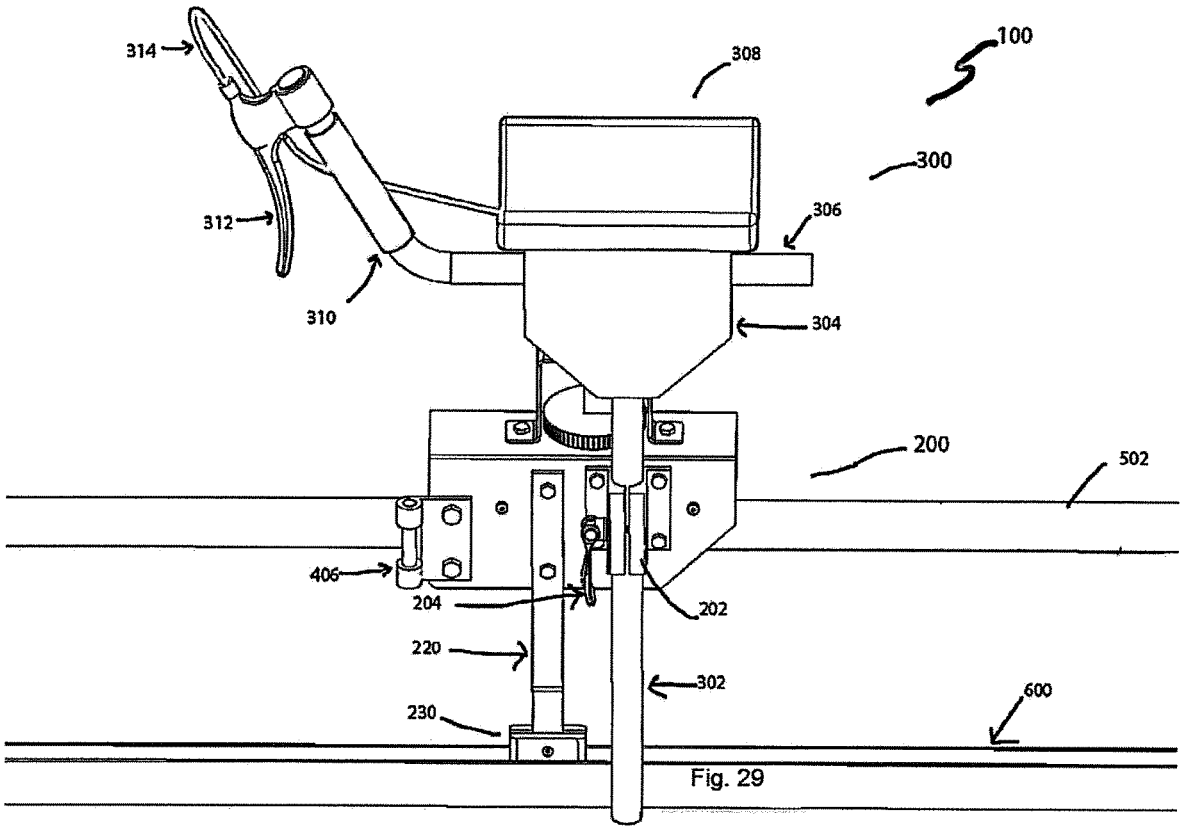
FIG. 29 is a line drawing of a close up view of UE Support Assembly and Rotation Brace and stabilizing rail in FIG. 28.
Figure 30:
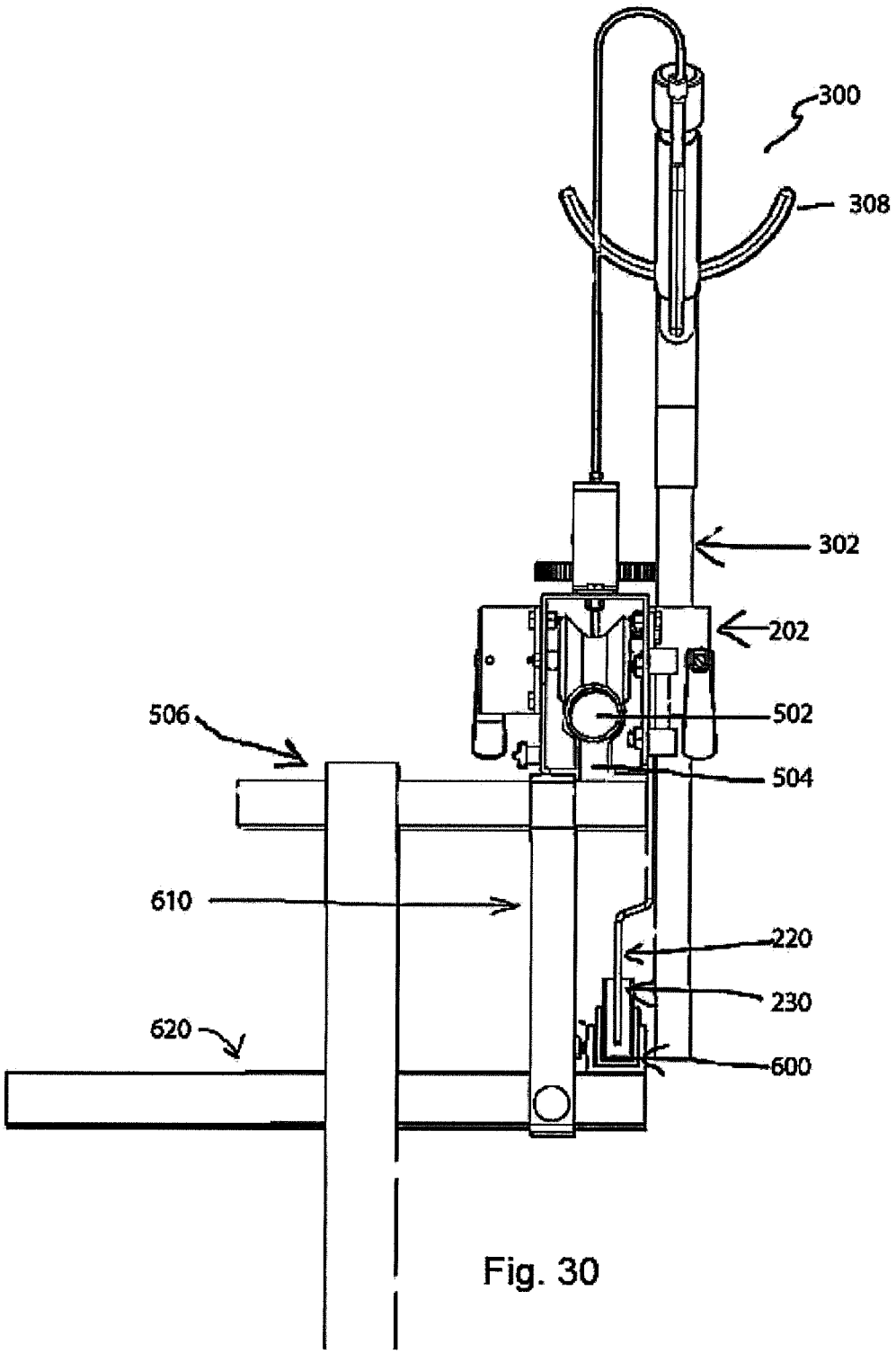
FIG. 30 is a cross sectional view of the components shown in FIG. 29.
Figure 31:
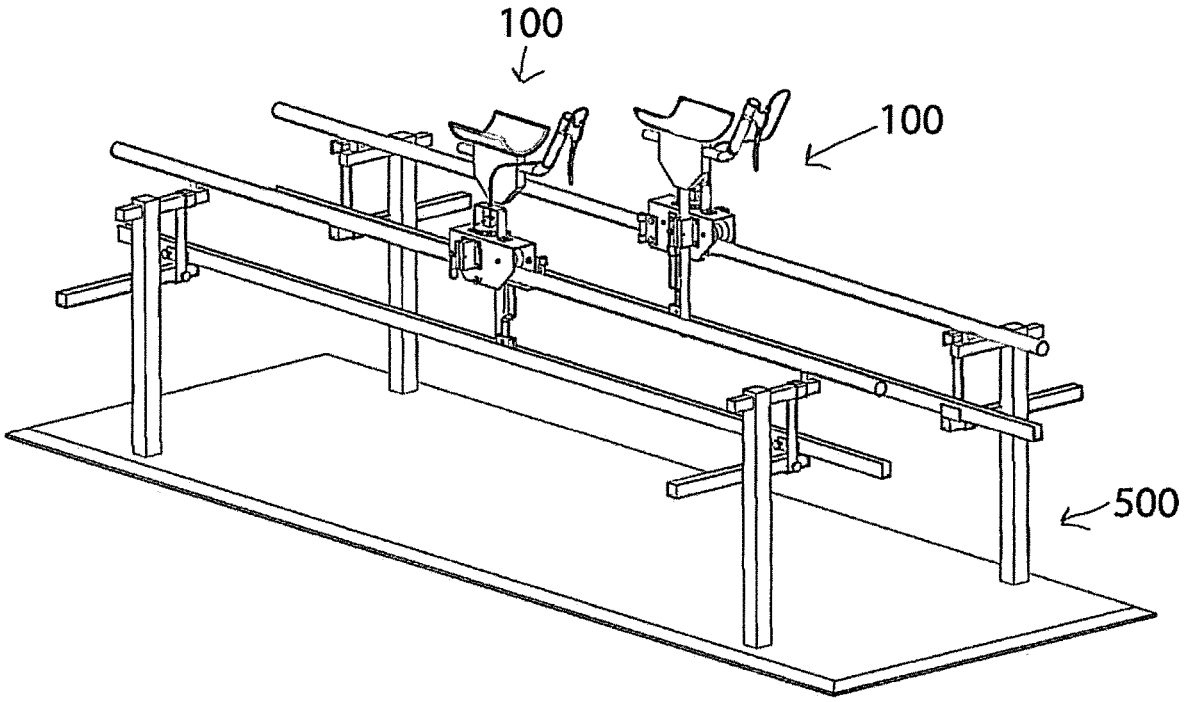
FIG. 31 is a drawing of (2) unilateral systems, one upon each of two rails of parallel bar device.

An anterolateral view of the device is shown in FIG. 28 on a parallel rail device. A medial view of the device in FIG. 28 is shown in FIG. 29. A cross sectional view of the assembly in FIGS. 28 and 29 is shown on FIG. 30. The lower portion of the vertical rail support and the walking surface of the railed device have been removed. FIG. 31 illustrates a lateral view of the mobile housing components with housing removed from FIG. 30. FIG. 31 illustrates two unilateral systems on a parallel rail device.

As presented in FIG. 28, one mobile support assembly 100 includes a housing 200 and a forearm support surface assembly 300. The mobile assembly 100 is positioned on one rail 502 of the parallel bar device 500. The stabilizing rail 600 is secured to the railed device frame by hangers 610 and horizontal U channel braces 620. In FIG. 29, a forearm support assembly 300 includes a vertical support tube 302 extending from the body of the assembly 304. A grip handle tube 306 and associated grip handle 310 are secured to the body of the device and a forearm trough 308 is situated on top. A brake lever 312 is attached to the grip handle and a brake cable housing 314 is in place. An arm support bracket 202 and associated locking lever 204 are placed medially and laterally on the housing. A hinge member 406 is secured to the housing 200 and is available for attachment of a hinged assembly arm assembly (FIG. 1) which connects two housings, one on each rail, and which offers additional functionalities as described in the accompanying disclosure (crossover arm design assembly).

The rotation bracket 220 extends from the housing 200 to the track glider 230 positioned in the stabilizing U channel 600. A cross sectional view of the mobile support assembly with stabilizing components in place is illustrated in FIG. 30. In FIG. 30, the attachment mechanism of the rail 502 to the supporting frame of the parallel bar device can be appreciated. This is one variety of methods used to connect a rail to the frame of the device. The design of the housing 200 in this device accommodates this design, in that the housing can be installed on the rail 502 by sliding the device over the end of the rail. This is possible due to the opening on the underside of the housing which accommodates the vertical peg 504 extending from horizontal frame member to the underside of the railing 502.

In FIG. 6, the support surface and housing have been removed, and as such, the inner components of the housing are shown which include the brake block 216, two track wheels 218, and removal stop 206 with tightening knob 207. The brake cable extends downward through the brake bracket 208 and through the cable clamp 210 which rests upon the parking brake knob 212. A long threaded bolt 214 is inserted up through a hole in brake block 216, through hole in parking brake knob, and then threaded into underside of cable clamp. Squeezing the brake lever causes the brake block to be elevated from a resting position within the housing, such that the lower margins of its arcuate surface make progressively greater contact with the rail, as the brake is more fully engaged. Rotating the parking brake knob prior to use of the device enables positioning of the brake block in order to select the amount of resistance to glide. Maximal rotation of the parking brake knob causes the housing to be stably positioned about the rail such as desired when static UE support is desired. The resistance to glide can be adjusted by rotating the brake control knobs and can be adjusted for symmetrical or asymmetrical resistance to glide as desired. The removal stop 206 serves to properly position the brake block in vertical orientation and keeps the housing assembly secured about the rail. This embodiment could be incorporated bilaterally for bilateral support as illustrated in FIG. 31. Two forearm support assemblies are incorporated in this example. Any combination of grip handle or forearm support assemblies can be incorporated. Also, the hinged crossover arm assembly described above can be introduced by securing the hinges on each of the two ends of the crossover arms to each of the two housings, in order to incorporate the functional benefits of using this interconnecting member described above. Other interconnecting members between assemblies could also be introduced, such as a reverse motion linkage creating equal and opposite motion between the two mobile assemblies.

Various examples of cane handle assembly and forearm support assembly designs are shown in FIGS. 18A-18E and 18F-18J. A brake lever is variably incorporated in the handle portion of any of these assemblies in order to accept the brake cable and cable housing attached to the housing. In the event variable resistance to glide and hand braking is not desired, a brake lever is not needed as a component of the support surface.

The U Channel is properly positioned by proper installation of the hanger and U channel brace components on the frame of the railed device. As described above, the housing design allows for sliding the housing over the end of the rail, with all inner components of the housing intact, for the parallel bar device design which has a vertical peg on the underside of rail for connection to the vertical frame members of the railed device. This can be accomplished concurrent with introduction of the track glider to the U channel, with the rotation brace already secured to the housing. Variably, the housing can be introduced to the rail, and subsequently the track glider is introduced to the U channel and the rotation brace is secured to the housing at the upper end and to the track glider at the lower end. For parallel bar designs with alternate attachment mechanism of the rail to the device frame, the Housing can be introduced at any point along the rail between the vertical uprights. The removal stop must be removed from its position within the housing in order to attach to the rail. This is accomplished by loosening the knob 207. The brake bracket can be used to lift and carry the housing, including putting it in place on the rail. Once the housing is in place and (2) wheels are hence in contact with the rail, the removal stop is inserted from underside of housing in upwardly direction until it is in proper position and then the removal stop knob is tightened. Static positioning of the removal stop serves to maintain alignment integrity of the track wheels and brake block about the rail. It maintains proper positioning of the brake block as the brake block moves vertically during use. Motion stop blocks can be positioned at both ends of both rails, such as in FIG. 9, in the description of the accompanying disclosed assembly, the crossover arm design assembly. These are statically positioned housings which prevent a mobile housing from gliding off of a rail and are attached to the rails after the housing(s) are mounted, if mounted by sliding the housing over the end of the rail. Motion stop blocks can also be positioned adjacent to both ends of the housing in order to statically position the housing along the rail. If the housing is mounted at any point along the rail between the vertical support members of the rails (and thus between the attachment points of the rail to the railed device frame), the motion stop blocks can be installed before the assembly is mounted. Of course, when a support assembly is statically positioned in order to provide static UE support, a motion stop block(s) would not be needed. The desired support assembly (forearm support assembly or grip handle assembly), is installed by sliding the vertical supporting tube into either the medially- or laterally-positioned arm support bracket, rotating the tube such that the grip handle component of the selected assembly is facing the proper direction, and adjusting the height of the support surface for form, fit, function, and securing it in place by rotating the lever to tighten the longitudinal bracket about the tube, and folding it down to lock in place. The support surface is rotated 90 degrees to enable the user to face perpendicular to the rail. Two (2) housings can be introduced to one (1) rail, with UE support assemblies rotated 90 degrees such that the user is positioned facing the rail, such as would be needed to enable sidestepping when bilateral UE support desired. In order to turn and walk in the reverse direction, such as in a two railed device environment, an assembly would be positioned on the opposite rail, with the support surface facing the opposite direction in order to support the same upper limb.

The brake cable/housing is secured in the brake lever assembly secured to the grip handle of either the grip handle assembly or forearm support assembly. Variable resistance to glide is set prior to use by adjusting the brake knob. Hand braking of the assembly can be performed by the user to arrest movement of the mobile assembly during use. If the assembly is used in a bilaterally railed environment, the rail width is adjusted for fit and function. If an assembly is to be incorporated on both rails of a parallel bar device, the same procedure described above is completed for the assembly on the second rail. Unilateral mobile UE support offers multiple functionalities. An upper limb can be supported and advances with the user's body. The continuous mobile support enables active mobilization of the upper limb to the extent the user is able or desires to move the limb. The continuous mobile support enables and facilitates advancing an UE and statically positioning the support with or without using the hand brake, such as is needed to perform two point or four point gait patterns. Three point, step to gait training is enabled on a two railed device when upper limb support is needed on one side. Reciprocating UE movement concurrent with walking is enabled and facilitated by the mobile forearm or grip handle support. In cases involving distal UE dysfunction prohibiting secure gripping of the rail, an orthosis can be incorporated to secure a user's hand to a grip handle, thus enabling grip support.

Figure 32:
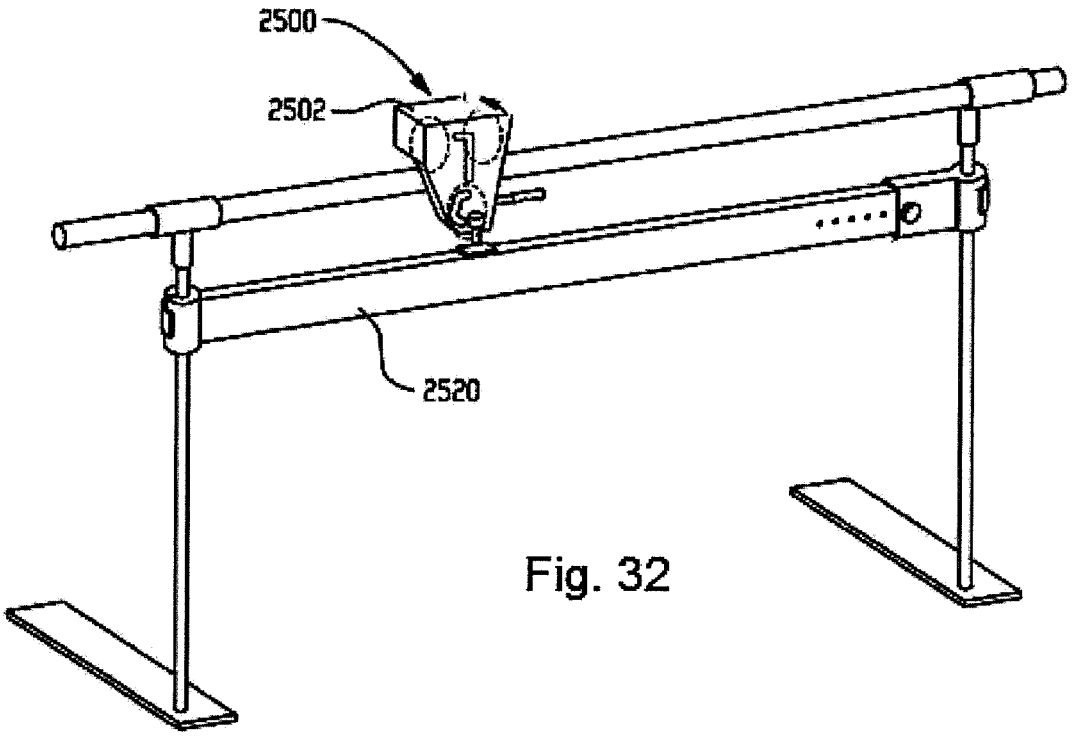
FIG. 32 is a line drawing of a Unilateral System #2 shown on a single railed device. A support surface assembly has not yet been attached to the rail linkage assembly.
Figure 33:
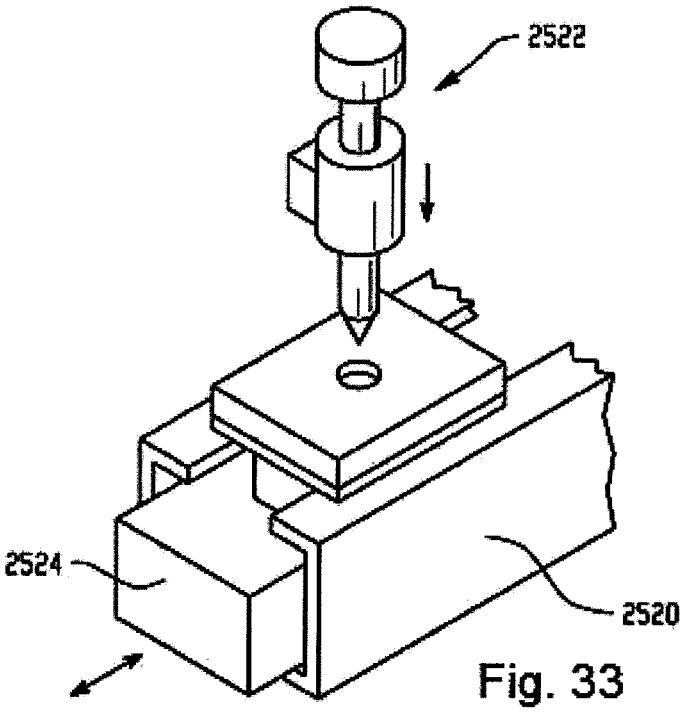
FIG. 33 is a drawing of the attachment mechanism of the housing to the bearing slider which is positioned within the lower support rail.
Figure 34:
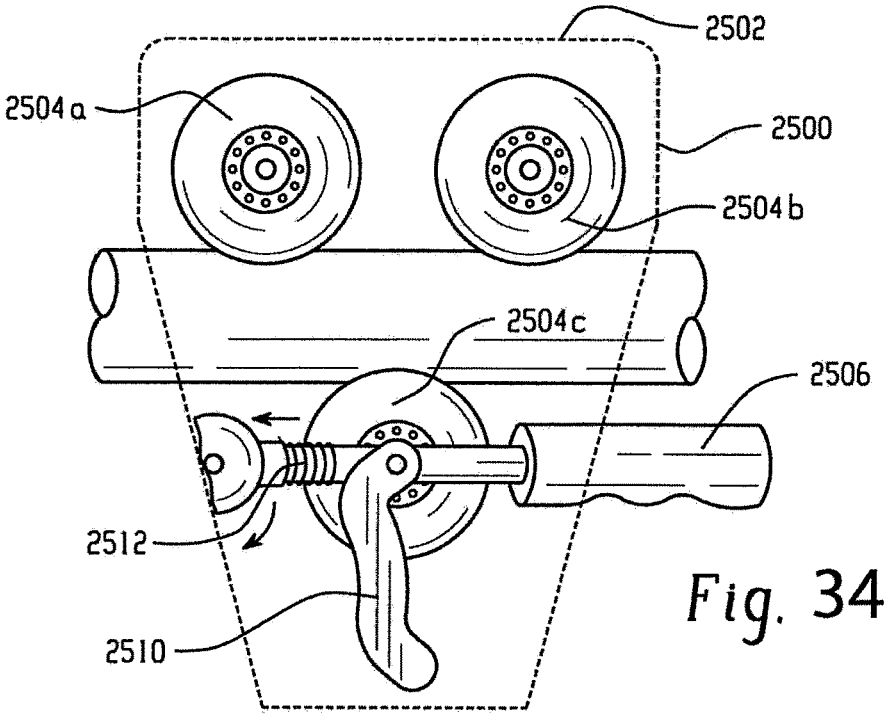
FIG. 34 is a drawing of a glider to which a support surface would be attached in order to create a mobile UE support assembly.
Figure 35A:
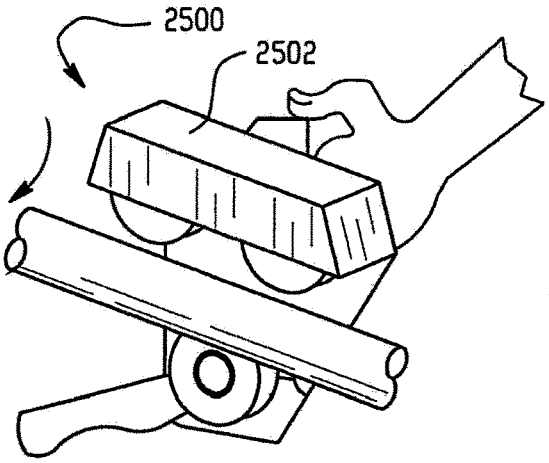
FIGS. 35A-35C are drawings which illustrate the sequential steps involved in mounting the mobile housing in FIG. 34 to the rail
Figure 35B:
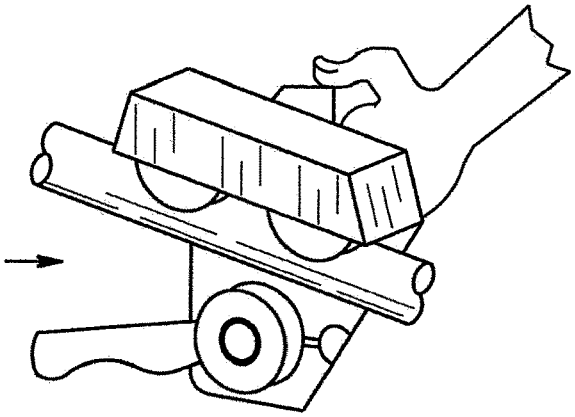
Figure 35C:
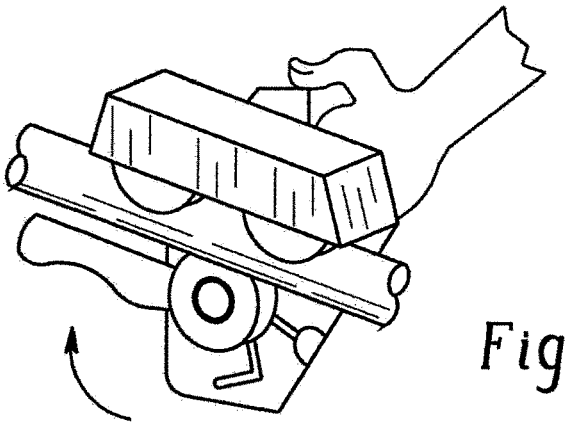

A second embodiment of a unilateral system includes a stabilizing rail secured to the railed device frame, and is presented in FIGS. 32-38. An UE support assembly has not been shown in FIG. 32, but it is understood that a forearm support assembly or a grip handle assembly would be secured in some fashion to the mobile housing (support member) such as by securing a vertical support tube within a tube clevis. A mobile UE support assembly is created upon attaching the support surface to the mobile support member. FIGS. 32-34, 35A-35C, and FIG. 38 illustrate a glider concept for a support member, or housing, 2500. The assembly is attached to a railed device with a single rail, in FIG. 32, and is attached to one rail of a two railed device, a treadmill with side rails, in FIG. 38. The mobile UE support assembly 2550 in FIG. 38 has the mobile housing 2500 and an UE support surface assembly, which is a forearm support assembly in this embodiment. A planar upper surface 2502 of the support member 2500 is maintained in a desired horizontal relationship by using multiple wheels or rollers 2504, shown here as three grooved wheels received around circumferential portions of the rail. Here, two of the wheels 2504*a*, 2504*b* are configured to roll along an upper surface of the rail while the third wheel 2504*c* is configured for rolling engagement along a lower surface of the rail generally opposite the other two wheels. At least one of the wheels, shown here as the third wheel 2504*c*, is selectively movable via handle 2506 that uses a spring force to hold the third wheel against the rail. An opening 2510 in the housing that forms a portion of the support member 2500 in conjunction with a spring 2512 holds the third wheel in either a biased open or biased closed position. FIGS. 35A-35C illustrate the sequential steps involved in mounting the support member 2500 to the rail, and bringing the third wheel 2504*c* into engagement with the underside of the rail. FIGS. 32 and 33 illustrate a lower support rail 2520 that is interconnected to the housing that forms the support member 2500. A grooved interconnection member 2522 is partially received in the housing of the support member 2500, and partially received in operative engagement with a bearing slider 2524 received in the lower support rail 2520. Of course other interconnections may be used; however, the lower support rail 2520 prevents undesired roll or rotation of the support member 2500 relative to the rail.

Figure 36A:
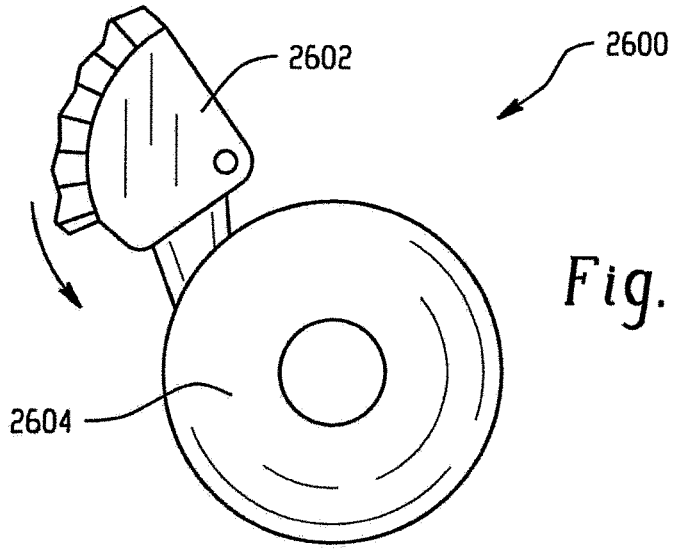
FIGS. 36A-36C are illustrations of different brake concepts that can be used for braking of the wheel(s) of the assembly shown in FIG. 34.
Figure 36B:
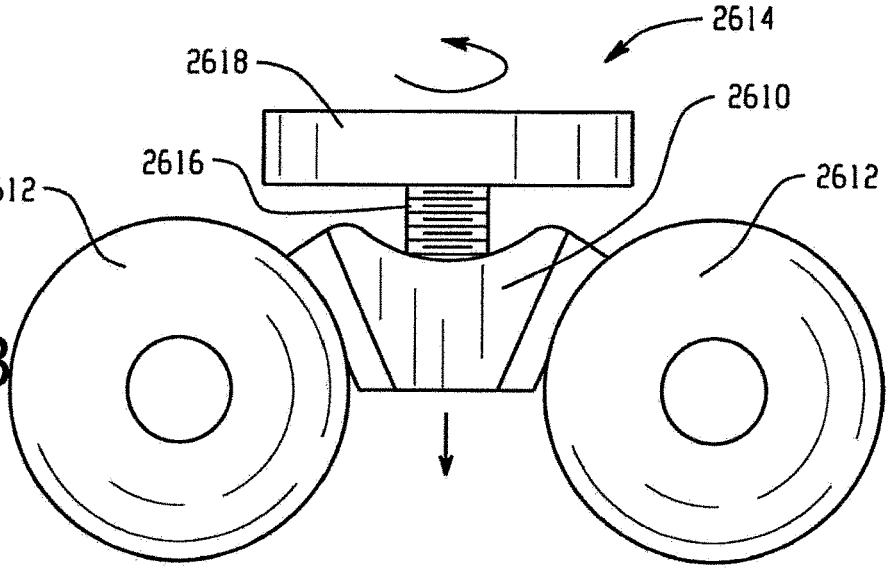
Figure 36C:
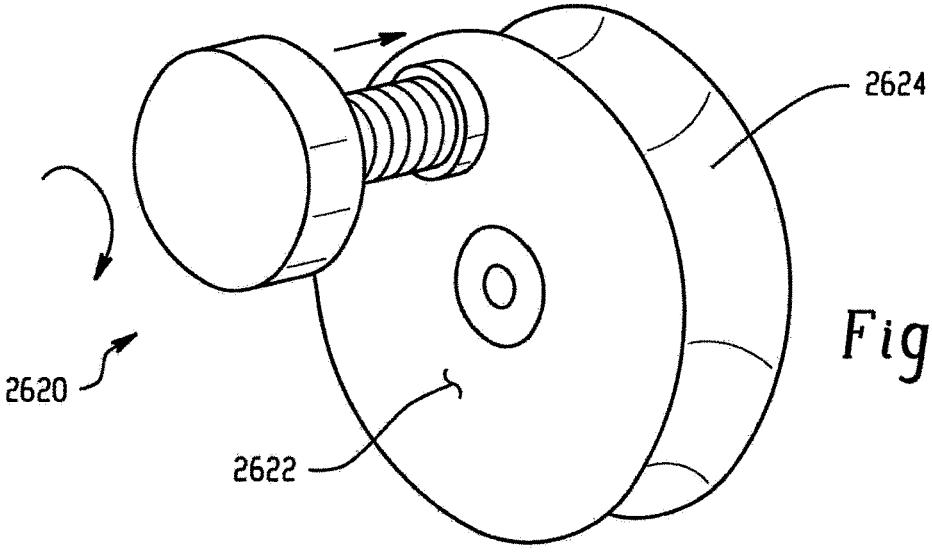
Figure 37A:
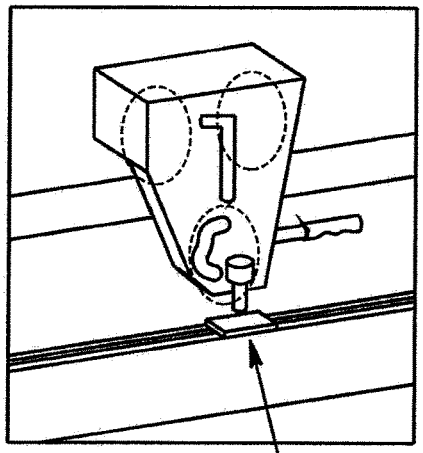
FIGS. 37A-37C are illustrations of mechanisms to provide static positioning of, to delimit the range of movement of, and to provide a variable resistance mechanism for the assembly in FIG. 34.
Figure 37B:
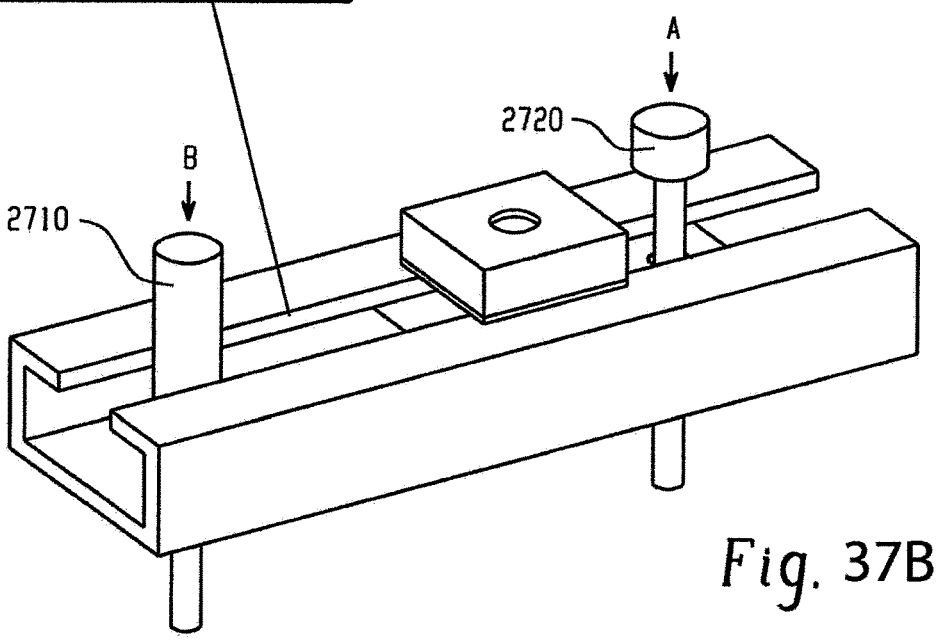
Figure 37C:
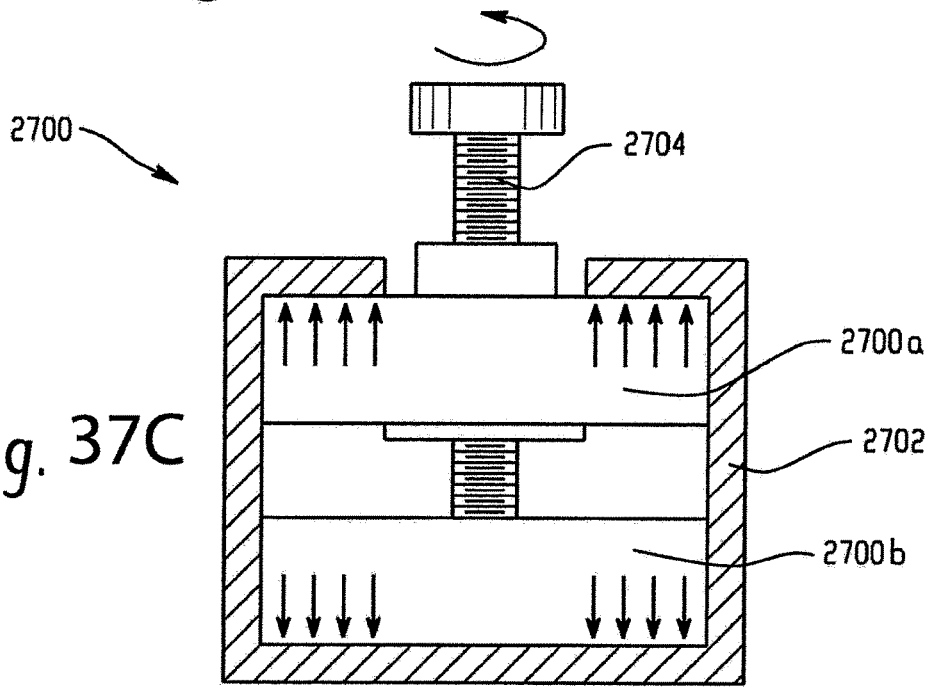
Figure 38:
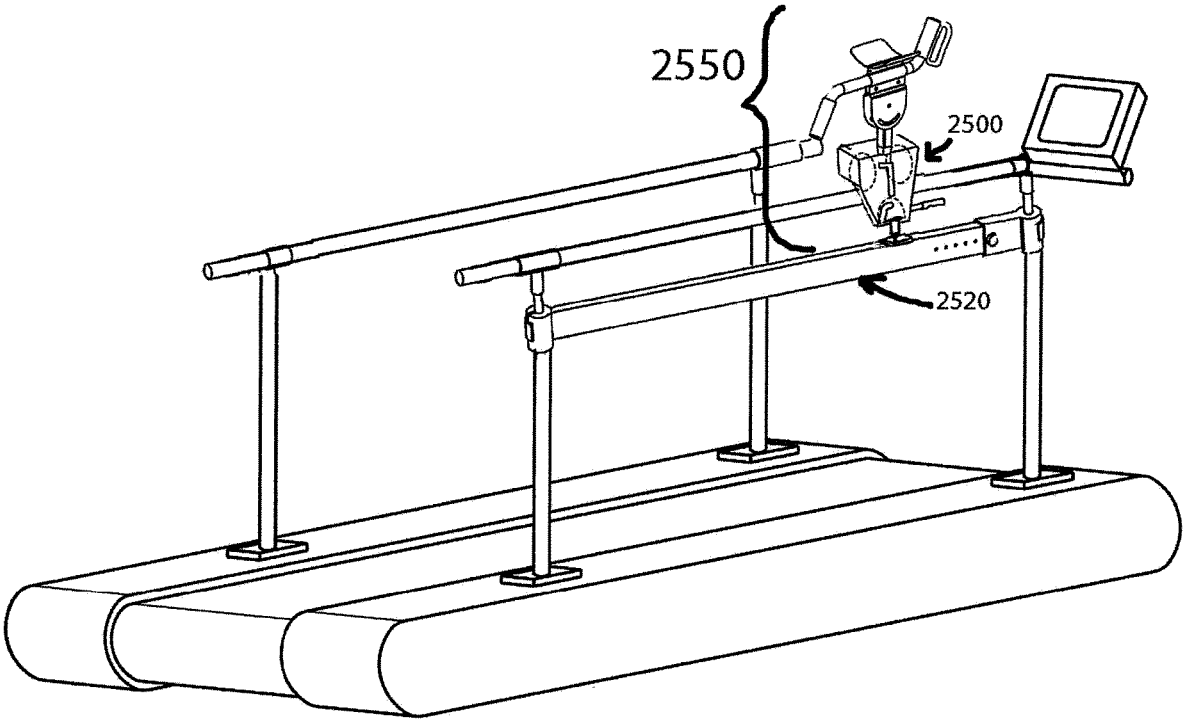
FIG. 38 is a drawing of a Unilateral System #2 positioned on a treadmill offering forearm support.

FIGS. 36A-36C illustrate different brake concepts that can be used to lock a mobile support member 2600 relative to its associated rail. In FIG. 36A, a rubber stopper 2602 is selectively pressed into the groove of one of the wheels 2604 (for example, of the type shown and described in FIGS. 33-35). In FIG. 36A, the rubber stopper 2602 is selectively pressed radially into the groove of the wheel 2604 and can be actuated by a conventional hand brake actuator (not shown). This type of brake does not allow for variable resistance. FIG. 36B advances and retracts a wedge shaped member 2610 to selectively engage two of the wheels 2612. An actuator 2614, such as a threaded member 2616 with an actuating handle 2618, is mounted to the support member 2600 and selectively advances and retracts the wedge shaped member 2610 and can provide for variable resistance. FIG. 36C is a friction type stop 2620 that allows for fast, independent, and variable resistance to be applied to a surface 2622 of one or more of the wheels 2624. FIGS. 37A, 37B, and 37C expand upon the bearing slider assembly of FIG. 33 to provide for delimiting the range of movement and for variable resistance. FIG. 37A shows the bearing slider attached to support assembly. As seen in FIG. 37B, pegs or stop members 2710 may be selectively positioned at desired axial locations on the lower support rail to define stops that limit the range of axial movement of the mobile support member along the rail. Likewise, similar pegs or rods 2720 can be used to fix the mobile support assembly relative to the rail/lower support rail and preclude relative movement of the mobile support member until the peg/rod 2720 is released. As seen in FIG. 37C, the bearing slider 2700 is a split assembly received in the lower support rail 2702. A threaded shaft 2704 selectively expands and retracts the first and second portions 2700*a*, 2700*b* of the bearing slider assembly 2700 into abutting, resistive engagement with interior surfaces of the support rail 2702.

Figure 39:
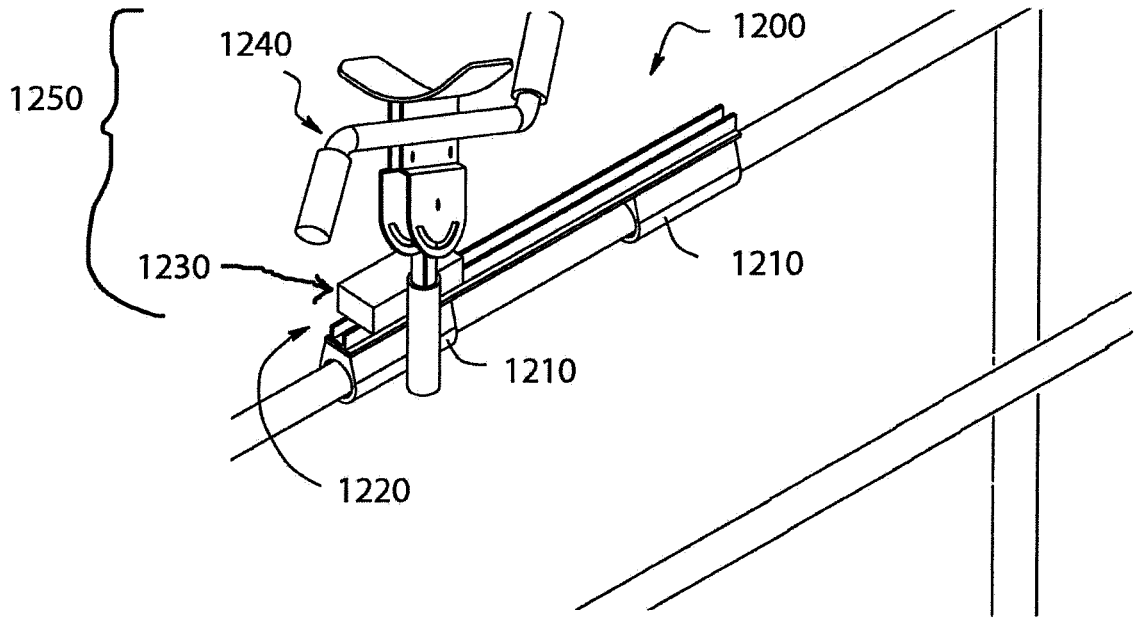
FIG. 39 is a drawing of a Track System on one rail of a parallel bar arrangement.

FIG. 39 is a drawing of another way in which unilateral mobile UE support can be achieved on a railed device. A track system 1200 is presented. A track 1220 is stably positioned upon a rail by two or more track mounting members 1210. The mobile UE support assembly 1250 is comprised of a UE support surface assembly 1240 secured to a mobile assembly 1230 which glides along the track. The support surface in this embodiment is a forearm support assembly. Variably, a grip handle assembly could be attached to offer mobile unilateral grip handle support. The tubular grip component of the support assembly has a handle on both ends which enables rotating the tubular member 180 degrees as opposed to rotating the vertical support tube of the assembly, in order to allow bidirectional ambulation.

Figure 40:
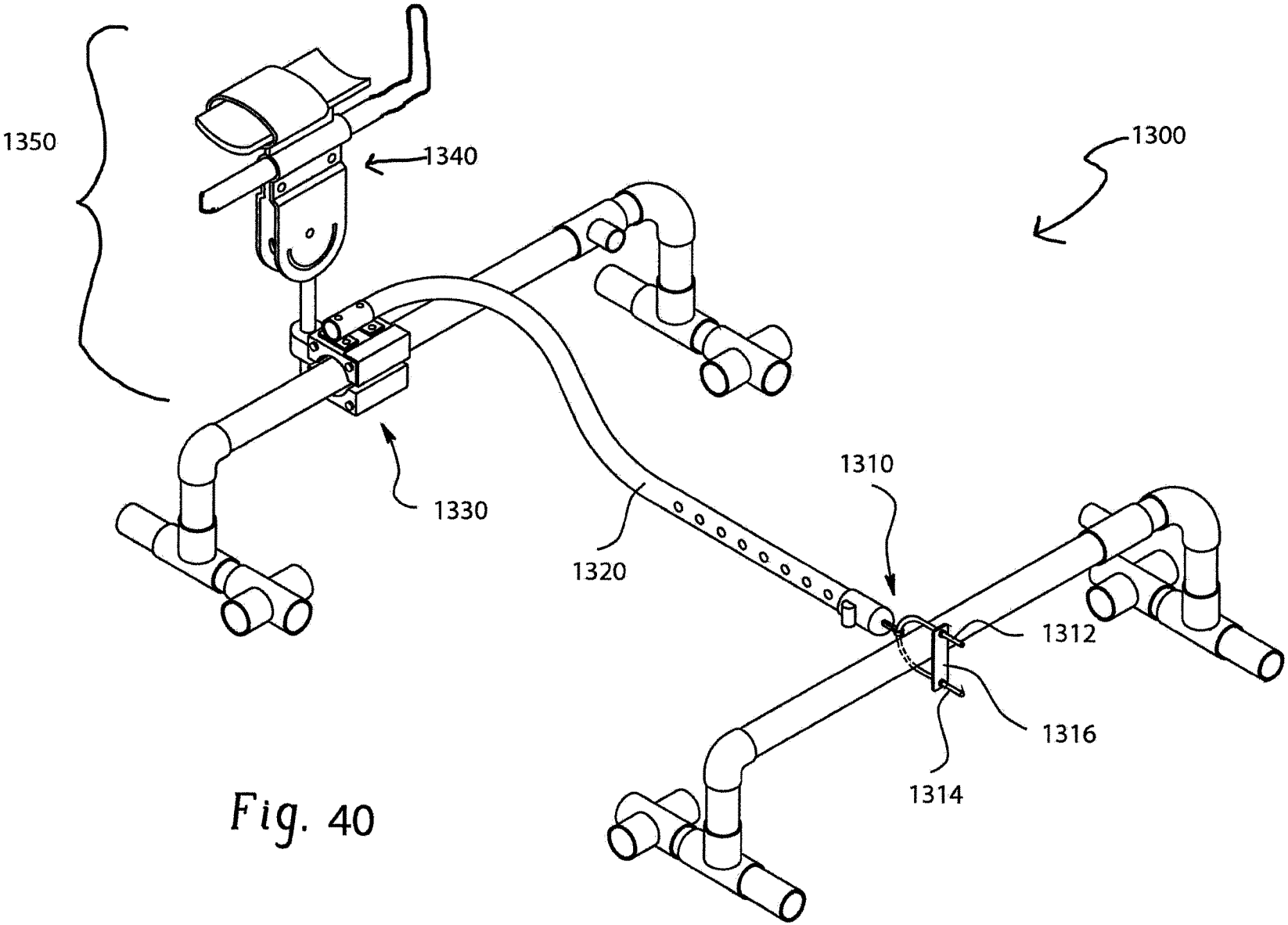
FIG. 40 is a drawing of an alternate method to stabilize a support assembly upon one rail by incorporating the second rail of a two railed device. A stabilizing bar with a bifurcated end is attached to the mobile housing and to the second rail. Unilateral forearm support is provided in this embodiment.

Yet another method of achieving unilateral UE mobile support is illustrated in FIG. 40. This device requires a device with two rails. A portable tabletop variety of a two railed device is shown. Stability of the mobile support assembly is achieved by providing a bifurcated or forked support 1310 that extends over one of the rails. The mobile UE support assembly 1350 consists of a mobile housing 1330 and a support surface assembly 1340 which in this embodiment is a forearm support assembly. The support assembly may include any one of a variety of supports for the affected UE. The mobile assembly is positioned on the left hand rail. A cross linkage member 1320 extends from the mobile housing 1330 toward the other rail (the right hand rail as illustrated). Adjacent the second rail, the end of the cross linkage member 1320 includes a bifurcated structure 1310 that is shown as a forked assembly received for sliding engagement relative to the second rail. Particularly, the forked assembly 1310 has a first or upper member 1312 that slides along an upper surface of the second rail and similarly a second or lower member 1314 that slides along a lower surface thereof. Further, a closure member 1316 may be provided along an outer region of the rail and extends across the upper and lower members in interconnecting fashion. By substantially surrounding the second rail, the cross linkage member 1320 provides increased stability to the mobile assembly on the opposite rail, namely, increased stability against rotation. Moreover, this is achieved without exerting undue drag or resistance on the mobile housing 1330. The length of the cross linkage member is adjusted to accommodate the desired width of the parallel bars, by extending the telescoping member and securing for example with snap pins. The shape of the cross linkage member illustrated would allow for ambulation with the member anterior to the user's body. Also, the forearm support assembly could be rotated 90 degrees to enable sidestepping activities. The member 1320 is maintained in perpendicular position relative to the rails, and the bifurcated structure 1310 slides along its rail in the same direction that the housing 1330 glides along its rail. The user is able to move the supported UE as able or as desired, while standing or walking in the railed device. Unilateral static and mobile UE support on a railed device can also be achieved in the absence of mechanical stabilization methods.

Figure 41:
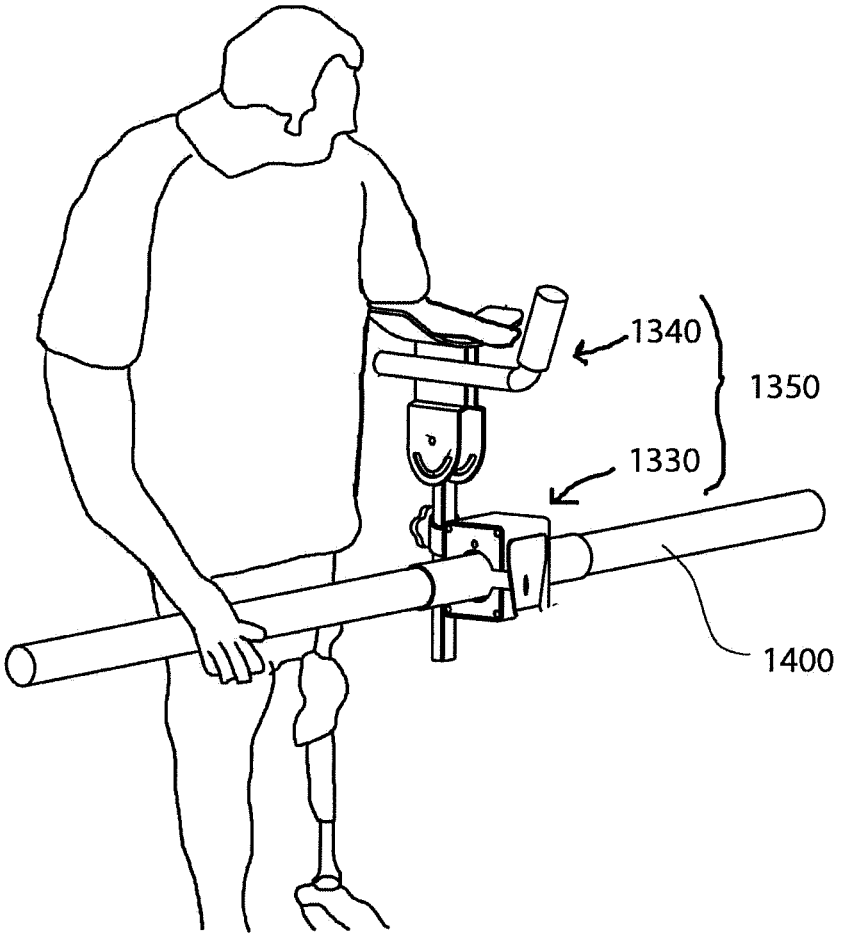
FIG. 41 is a drawing of a user using a forearm support assembly without stabilizing components. The assembly is being used for either static or mobile unilateral UE support while the user stands perpendicular to the rail.

In FIG. 41, the cross linkage member 1320 shown in FIG. 40 has been removed from the mobile housing 1300 and the forearm support assembly rotated 90 degrees to enable side stepping activities along rail 1400. Maintaining the support assembly in the upright position requires active stabilization of the device by the user. Variably, the housing can be secured on the rail for static positioning and static UE support as follows. The two piece assembly is held together by bolts which can be maximally tightened to disallow any translation of the mobile housing on the rail.

Figure 42:
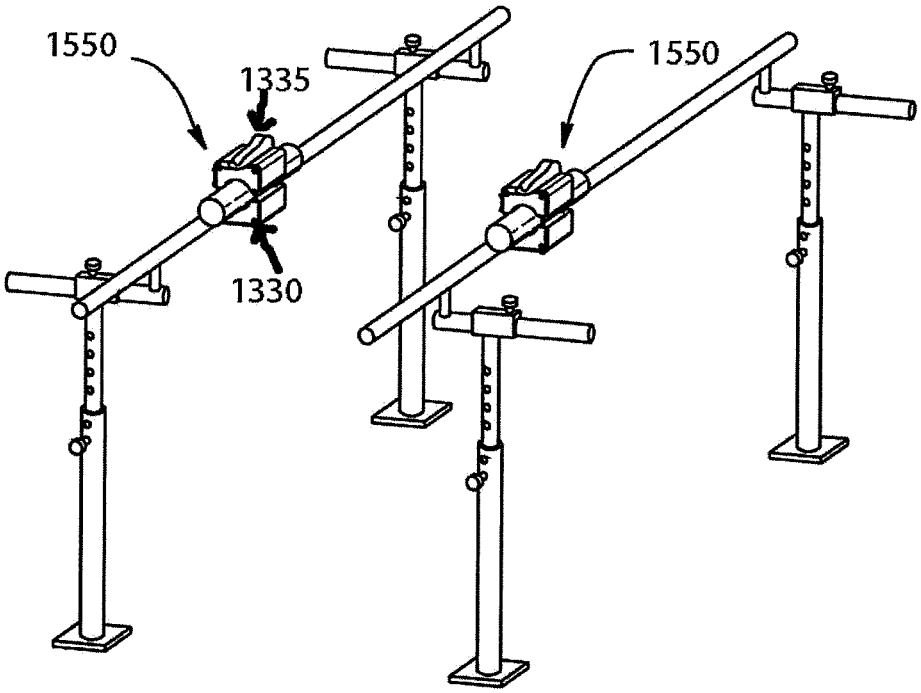
FIG. 42 is a drawing of mobile grip assemblies used on each of two rails, for mobile grip support in a parallel bar environment.
Figure 43:
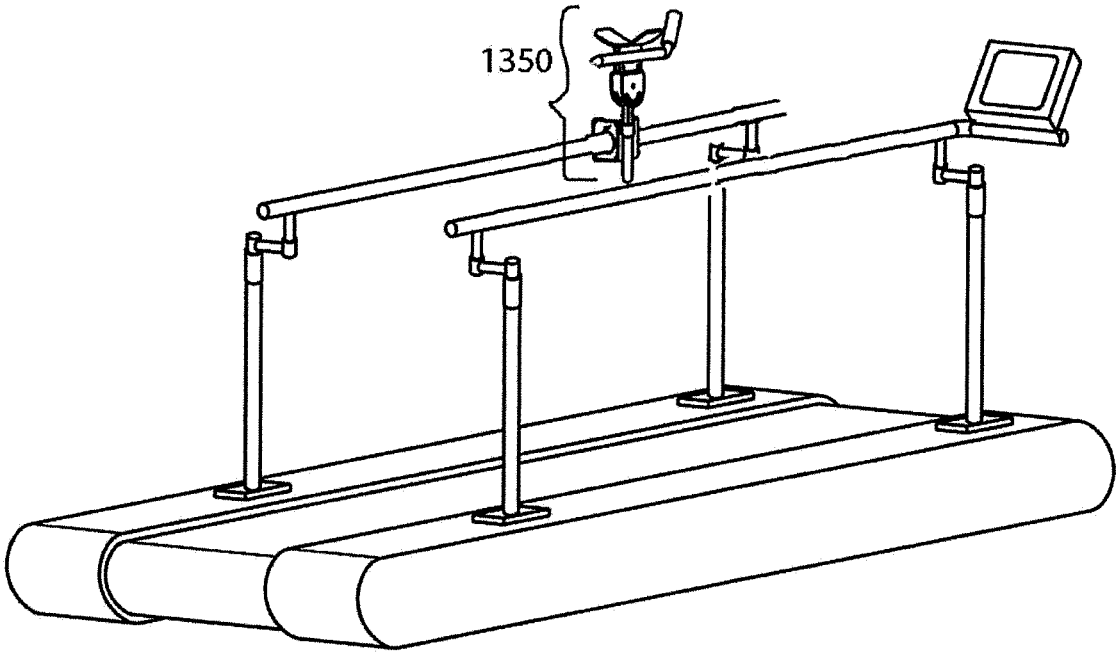
FIG. 43 is a drawing of an UE support assembly statically positioned on a treadmill rail.

The static UE support assembly 1350 is shown on one rail of a two railed treadmill device in FIG. 43. Mobile grip handle supports 1550 incorporated bilaterally in a parallel bar device are shown in FIG. 42. Mobile UE support is offered on each of two rails, such as might be desirable to facilitate training in arm swinging movement during ambulation activities in a railed environment. Of course, the grip assembly can be used on one rail when this is desired as well. Grip handle support surfaces 1335 are secured to the top surfaces of each of the two housings 1330 and are shown statically positioned as described above. In order to use for mobile grip support, the nuts securing the bolts in place are loosened, which enables the housing(s) to glide along the rail. Various ones of the grip handle assemblies (FIGS. 18A-18E) can variably be attached to any of the rail linkage assemblies in the above embodiments, while FIGS. 18F-18J are various forearm support assemblies that can be used. The vertical tube member is inserted into the arm support bracket which is a component of the housing in the first unilateral design. A similar bracket would be installed to the rail linkage assembly/housing of the second unilateral design for similar functionality. The rail linkage assemblies in FIGS. 39-43 have a tube clevis on lateral aspect for accepting the vertical support tube. It is understood that multiple other methods of attaching a support surface assembly to a housing could be achieved.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

I claim:

1. A patient aid assembly for use with an associated device having at least a first horizontal rail, the patient aid assembly comprising:

an upper extremity support assembly configured to support a portion of an upper extremity of an associated user;

a housing operatively associated with the upper extremity support assembly and the housing slidingly engaging the rail and allowing relative movement therealong when the associated user is adjacent the rail and allowing movement of an associated user relative to the rail in a longitudinal direction generally parallel to the rail;

at least one stop member located along the first rail whereby the at least one stop member limits an extent of movement of the support assembly in at least one direction along the first rail; and a brake member separate from the at least one stop member that selectively stops movement of the housing relative to the first rail.

2. The patient aid assembly of claim 1 further comprising an elongated stabilizing rail extending parallel to the first rail, and a stabilizing member extending from the housing and operatively engaging the stabilizing rail to prevent rotation of the housing about a longitudinal axis of the rail.

3. The patient aid assembly of claim 2 wherein the stabilizing rail and the stabilizing member are configured for operative engagement with the first rail.

4. The patient aid assembly of claim 2 wherein the stabilizing rail is a second rail that receives a second upper extremity support assembly configured to support an other side of the upper body of the associated user, and a housing operatively associated with the second support assembly and the housing slidingly engaging the second rail and allowing relative movement therealong, and the stabilizing member includes a hinge that extends between the first and second housings.

5. The patient aid assembly of claim 2 wherein the stabilizing rail has a channel that receives a slide member of the stabilizing member for gliding movement therein.

6. The patient aid assembly of claim 2 wherein the stabilizing member includes a bar extending generally perpendicular from the first rail toward the stabilizing rail, and including first and second branches diverging from the bar and received on opposite surfaces of the stabilizing rail.

7. The patient aid assembly of claim 1 wherein the housing has a surface that conforms to at least a portion of an exterior surface of the first rail.

8. The patient aid assembly of claim 1 further comprising a variable resistance member for selectively altering resistance to sliding movement of the mobile support assembly relative to the first rail.

9. The patient aid assembly of claim 1 wherein the upper extremity support assembly is one of either a forearm support assembly or a grip handle assembly.

10. The patient aid assembly of claim 9 wherein the forearm support assembly includes (i) a forearm support member to support at least a portion of a forearm of an associated user and (ii) a grip handle configured for gripping by the associated user.

11. The patient aid assembly of claim 1 further comprising a stabilizing rail and a hanger system that mounts the stabilizing rail to the first rail.

12. The patient aid assembly of claim 1 further comprising a stabilizing rail and a frame that supports the stabilizing rail at a desired location relative to the first rail.

13. The patient aid assembly of claim 1 further comprising a track mounted intermediate the housing and the first rail wherein the housing slides along track and thereby moves relative to the first rail.

14. The patient aid assembly of claim 1 wherein the housing has at least one wheel in contact with at least a portion of an exterior surface of the first rail.

15. A patient aid assembly for use with an associated device having at least a first horizontal rail, the patient aid assembly comprising:

an upper extremity support assembly configured to support a portion of an upper extremity of an associated user;

a housing operatively associated with the support assembly and the housing slidingly engaging the rail and allowing relative movement therealong when the associated user is adjacent the rail and allowing movement of an associated user relative to the rail in a longitudinal direction generally parallel to the rail; and a rotatable mount interconnecting the support assembly to the housing wherein the support assembly may be rotated through at least 180 degrees relative to the first housing.

16. The patient aid assembly of claim 15 further comprising at least one of first and second stop members located along the first rail whereby the at least one stop member limits an extent of movement of the support assembly in at least one direction along the first rail.

17. The patient aid assembly of claim 15 further comprising a brake member that selectively stops movement of the housing relative to the first rail.

18. A patient aid assembly for use with an associated device having first and second horizontal and parallel rails, the patient aid assembly comprising:

at least one of first and second upper extremity support assemblies configured to support a portion of at least one upper extremity of an associated user;

first and second housings operatively associated with at least one of the first and second support assemblies, respectively, and the first housing slidingly engaging the first rail, and the second housing slidingly engaging the second rail, each allowing relative movement therealong in a longitudinal direction when the associated user is adjacent to both rails and allowing movement of the associated user relative to the rails in a generally longitudinal direction parallel to the rails when at least one upper extremity is supported; and an interconnecting member having first and second interconnecting member portions each having a proximal end and a distal end;

a first hinge pivotally connecting the proximal end of the first interconnecting member portion to the first housing;

a second hinge pivotally connecting the proximal end of the second interconnecting member portion to the second housing;

a third hinge interconnecting the distal ends of the first and second interconnecting member portions to each other; and a selectively securable link interconnecting the first and second interconnecting member portions that in a first condition allows a relative orientation of the first and second mobile upper extremity support assemblies to vary as one or both housings move relative to respective first and second rails, and in a second condition fixes the relative orientation of the first and second mobile assemblies.

19. The patient aid assembly of claim 18 further comprising at least one of first and second brakes operatively associated with the at least one of first and second housings, respectively, that allow an associated user to selectively brake movement of at least the first upper extremity support assembly along the respective at least first rail.

20. The patient aid assembly of claim 18 further comprising at least one stop members located along at least one of first and second rails whereby the at least one stop member limits an extent of movement of at least one of first and second upper extremity support assemblies along the respective rail in at least one direction.

21. The patient aid assembly of claim 18 wherein each of the first and second housings has a surface that conforms to at least a portion of an exterior surface of the first and second rails, respectively.

22. The patient aid assembly of claim 18 further comprising at least one of first and second variable resistance members for selectively altering resistance to sliding movement of at least one of first and second housings relative to at least one of first and second rails, respectively.

23. The patient aid assembly of claim 18 further comprising one of either a forearm support assembly or a grip handle assembly on the at least one of first and second upper extremity support assemblies.

24. The patient aid assembly of claim 23 wherein each forearm support assembly includes a platform surface to support at least a portion of a forearm of an associated user and a handle configured for gripping by the associated user.

25. The patient aid assembly of claim 18 further comprising a first track mounted intermediate the first housing and the first rail wherein the first housing slides along first track and thereby moves relative to the first rail.

26. The patient aid assembly of claim 25 further comprising a second track mounted intermediate the second housing and the second rail wherein the second housing slides along second track and thereby moves relative to the second rail.

27. The patient aid assembly of claim 18 further comprising first and second symmetric mobile assemblies movable relative to said first and second rails, and first and second rotatable mounts interconnecting the first and second support assemblies to the first and second housings, respectively, wherein the support assemblies ma be rotated through at least 180 degrees relative to the housings.

28. The patient aid assembly of claim 18 further comprising first and second asymmetric mobile assemblies movable relative to said first and second rails.

29. The patient aid assembly of claim 18 further comprising a rotatable mount interconnecting the support assembly to the housing wherein the support assembly may be rotated through at least 180 degrees relative to the housing.

30. A patient aid assembly for use with an associated railed device having first and second horizontal rails, the patient aid assembly comprising:

asymmetrically positioned first and second housings;

first and second forearm support assemblies or first and second grip handle assemblies operatively associated with the housings;

a hinged interconnective assembly joining the forearm support assemblies or the grip handle assemblies;

a selective securable link in a locked condition allowing an associated user to move relative to the rails in a longitudinal direction generally parallel to the rails; and in a second condition to enable change in relative positioning of first and second support assemblies to enable an associated user to turn 180 degrees for walking in an opposite direction with the upper extremity supported.

* * * * *